US012000136B2

(12) United States Patent
Wang

(10) Patent No.: US 12,000,136 B2
(45) Date of Patent: Jun. 4, 2024

(54) FOLDABLE LIVING COMPARTMENT

(71) Applicant: Nan Ya Plastics Corporation, Taipei (TW)

(72) Inventor: Kuei-Yung Wang, Taipei (TW)

(73) Assignee: NAN YA PLASTICS CORPORATION (TW)

( * ) Notice: Subject to any disclaimer, the term of this patent is extended or adjusted under 35 U.S.C. 154(b) by 0 days.

(21) Appl. No.: 18/100,072

(22) Filed: Jan. 23, 2023

(65) Prior Publication Data

US 2023/0160195 A1 May 25, 2023

(51) Int. Cl.
*E04B 1/343* (2006.01)
*E04B 1/00* (2006.01)

(52) U.S. Cl.
CPC ..... *E04B 1/343* (2013.01); *E04B 1/34321* (2013.01)

(58) Field of Classification Search
CPC ..... E04B 1/34357; E04B 1/34321
USPC ..... 52/64
See application file for complete search history.

(56) References Cited

U.S. PATENT DOCUMENTS 2,453,221 A * 11/1948 Haden ..... F16B 5/0068 126/39 B
2,495,862 A * 1/1950 Osborn ..... E04B 1/10 52/578
2,647,287 A * 8/1953 Jones ..... E04B 1/34321 D25/33
2,718,210 A * 9/1955 Bonham ..... A01K 41/00 119/309
2,793,067 A * 5/1957 Couse ..... B60P 3/34 296/26.02
2,962,323 A * 11/1960 McBride ..... B62D 33/048 52/39
3,236,014 A * 2/1966 Edgar ..... E04B 1/34315 D25/1
3,369,335 A * 2/1968 Smith ..... E04B 1/10 52/270
3,372,520 A * 3/1968 Hensel ..... E04F 13/0826 52/489.1
3,626,649 A * 12/1971 Ohkawa ..... E04H 9/00 52/234
3,815,311 A * 6/1974 Nisula ..... E04B 1/08 52/579
3,866,381 A * 2/1975 Eschbach ..... B62D 33/046 52/262
3,984,948 A * 10/1976 Bussard ..... E04B 1/3442 52/79.5
4,027,912 A * 6/1977 Pacca ..... B60P 3/38 296/160

(Continued)

FOREIGN PATENT DOCUMENTS

CH 515392 A * 11/1971 ..... E04B 1/14
CN 115107555 A * 9/2022 ..... E04B 1/343

(Continued)

*Primary Examiner* — Brian D Mattei
*Assistant Examiner* — Joseph J. Sadlon
(74) *Attorney, Agent, or Firm* — OSTROLENK FABER LLP

(57) ABSTRACT

A collapsible living compartment comprising a frame supporting and a floor which is connected to a sidewall formed from two or more panels, wherein at least one of panels includes a supporting member and a passage embedded within a space defined between two outer skins, and at least part of the space is filled with insulating material.

18 Claims, 24 Drawing Sheets

(56) References Cited

U.S. PATENT DOCUMENTS 4,044,511 A * 8/1977 Lingle ..... E04B 1/6183 52/584.1
4,125,972 A * 11/1978 Pate ..... E04B 1/14 52/79.12
4,186,539 A * 2/1980 Harmon ..... E04B 1/6129 52/580
4,236,366 A * 12/1980 Rijnders ..... E04C 2/292 52/592.1
4,534,141 A * 8/1985 Fagnoni ..... E04B 1/3444 52/68
4,557,091 A * 12/1985 Auer ..... E04C 2/40 52/592.4
4,637,179 A * 1/1987 Bigelow, Jr. ..... E04B 1/34321 52/79.5
4,669,231 A * 6/1987 Bini ..... E04H 1/005 248/631
4,677,797 A * 7/1987 Roth ..... E04B 1/34321 52/282.3
4,854,094 A * 8/1989 Clark ..... E04B 1/3483 52/234
4,858,398 A * 8/1989 Ricchini ..... E04B 1/34315 52/584.1
4,869,030 A * 9/1989 Clark ..... B60P 3/32 182/88
4,884,376 A * 12/1989 DeBlock ..... E06B 1/363 D25/1
4,918,895 A * 4/1990 Landheer ..... E04B 1/6125 52/592.6
4,964,252 A * 10/1990 Guliker ..... E04H 1/1238 52/275
5,107,639 A * 4/1992 Morin ..... E04B 1/3445 220/6
5,271,687 A * 12/1993 Holka ..... B62D 27/026 296/205
5,274,975 A * 1/1994 Haag ..... E04B 1/12 52/239
5,343,666 A * 9/1994 Haddad ..... B62D 27/026 52/848
5,347,773 A * 9/1994 Thil ..... E04H 4/065 52/126.5
5,424,118 A * 6/1995 Mclaughlin ..... E05C 3/004 428/318.6
5,471,804 A * 12/1995 Winter, IV ..... E04B 1/14 403/231
5,483,778 A * 1/1996 Scrivener ..... E04B 1/14 52/592.1
5,571,230 A * 11/1996 Berg ..... E04B 1/34315 52/587.1
5,596,843 A * 1/1997 Watson ..... A01G 9/1415 52/63
5,746,333 A * 5/1998 Wuertemberger ..... A47B 47/0041 211/189
5,815,988 A * 10/1998 Molina ..... B60P 3/34 52/79.5
6,003,275 A * 12/1999 Cornell ..... E04B 2/827 52/64
6,332,298 B1 * 12/2001 Bigelow ..... E04B 7/08 52/236.7
6,387,533 B1 * 5/2002 Ast ..... B21C 23/22 52/763
6,393,772 B1 * 5/2002 McRoberts ..... G09F 7/18 52/39
6,658,808 B1 * 12/2003 Doherty ..... E04C 3/28 52/579
6,712,414 B2 * 3/2004 Morrow ..... B60P 3/34 52/79.5
6,729,085 B2 * 5/2004 Newhouse ..... B25B 5/003 52/584.1
7,043,789 B2 * 5/2006 Morrish ..... A61G 3/061 414/537
7,614,199 B2 * 11/2009 Smalley, III ..... E04B 1/14 52/235
7,966,782 B2 * 6/2011 Wood ..... E04B 1/0046 52/DIG. 17
8,065,846 B2 * 11/2011 McDonald ..... E04B 5/14 52/262
8,136,324 B2 * 3/2012 Browning ..... E04B 1/14 52/582.1
8,272,190 B2 * 9/2012 Schiffmann ..... B29D 99/0017 52/270
8,511,015 B2 * 8/2013 Behrens ..... E04B 2/827 49/501
8,640,410 B2 * 2/2014 Bergeron ..... E04B 1/14 52/592.1
8,893,439 B2 * 11/2014 Fujiwara ..... E04F 11/1808 52/64
8,955,281 B2 * 2/2015 Pietruczynik ..... B29C 48/175 52/630
9,060,652 B2 * 6/2015 Bikker ..... E04H 1/1216
10,167,624 B1 * 1/2019 Hodgetts ..... B60P 3/34
10,287,770 B2 * 5/2019 Hodson ..... E04C 2/288
10,487,499 B1 * 11/2019 Berkowitz ..... E04B 2/7425
10,570,617 B2 * 2/2020 Kolcun ..... E01F 8/007
10,767,363 B2 * 9/2020 Labala ..... E04B 1/34823
10,982,455 B2 * 4/2021 Wang ..... C08G 18/6492
11,084,413 B2 * 8/2021 Rasmussen ..... B60P 3/39
11,168,485 B2 * 11/2021 Yuen ..... C08G 18/6492
11,384,529 B2 * 7/2022 Johnson ..... B65D 90/143
11,408,165 B2 * 8/2022 Kolisnek ..... E04B 1/3483 52/234
11,473,291 B2 * 10/2022 Banerjee ..... E04B 1/34336
11,525,256 B2 * 12/2022 Tiramani ..... B32B 5/20
11,536,020 B2 * 12/2022 Bowron ..... E04G 21/142
11,623,830 B1 * 4/2023 Hall ..... E03F 5/10 414/495
11,629,493 B2 * 4/2023 Livingstone ..... E04C 2/48 52/91.3
11,697,938 B2 * 7/2023 Nguyen ..... E04B 1/6108 52/220.1
11,718,984 B2 * 8/2023 Tiramani ..... B32B 15/18 52/79.5
11,773,603 B2 * 10/2023 Cook ..... E04F 15/02188 52/79.1
2004/0101357 A1 * 5/2004 Dijkstra ..... B65D 7/24 403/403
2006/0048459 A1 * 3/2006 Moore ..... E04B 1/34321 52/79.1
2009/0133354 A1 * 5/2009 Spear ..... E04G 21/243 52/309.1
2011/0078960 A1 * 4/2011 Luttmann ..... E04B 2/827 52/64
2011/0162293 A1 * 7/2011 Levy ..... E04B 1/3483 52/79.9
2014/0059947 A1 * 3/2014 Rothwell ..... E04B 1/343 52/79.5
2016/0138258 A1 * 5/2016 Schaffert ..... E04B 1/3445 52/79.5
2016/0177565 A1 * 6/2016 Aykas ..... E04B 1/7038 52/64
2023/0358030 A1 * 11/2023 Yehia ..... E04B 1/34321

FOREIGN PATENT DOCUMENTS

EP 1647644 A2 * 4/2006 ..... E04B 1/34321
FR 2927340 A1 * 8/2009 ..... E04B 1/3408
WO WO 2005/089177 A2 9/2005
WO WO-2017065612 A1 * 4/2017 ..... E04B 1/34321

* cited by examiner

FOLDABLE LIVING COMPARTMENT

The present invention relates to a living compartment, for example particularly, but not exclusively, a collapsible living compartment.

BACKGROUND OF THE INVENTION

A foldable modular home is known and has been put forward as a quick fix for urgent need of temporary living space. The modular home can be collapsed or folded into a compact configuration for ease of storage and transport. Such a modular home is reusable by expanding it to create a closed space of reasonable size sufficient as a sheltered living area.

They are temporary measures. Building cost is a great concern. Weight is another important consideration, as it is intended to be portable. Quality is sacrificed for economic efficiency. These houses have poor insulation against external environment resulting in common problems such as leakage and overheating. Wiring and powering is another issue. As such foldable house is not common for human habitation but animals.

The invention seeks to eliminate or at least to mitigate such shortcomings by providing a modular living compartment that is well equipped for human habitation.

SUMMARY OF THE INVENTION

According to an aspect of the invention, there is provided a collapsible living compartment comprising a frame supporting and a floor which is connected to a sidewall formed from two or more panels, wherein at least one of panels includes a supporting member and a passage embedded within a space defined between two outer skins, and at least part of the space is filled with insulating material.

Preferably, the panel includes at least two passages provided adjacent to respective supporting members.

More preferably, the passages and the respective supporting members are provided at respective opposite end portions of the panel thereby defining the part of the space being filled with insulating material.

Yet more preferably, the opposite end portions are different in at least one dimension, such that when two panels are connected to one another, the opposite end portion of a smaller dimension in one panel is received by the opposite end portion of a larger dimension in another panel.

It is preferable that the passage and the supporting member at one opposite end portion are different in at least one dimension when comparing to that of the passage and the supporting member at the other opposite end portion.

Advantageously, the two panels are inter-engaged to form the sidewall via a coupler.

More advantageously, the coupler includes first and second coupling members provided with respective opposite end portions of the panel.

Yet more advantageously, the first and second coupling members are complementarily shaped.

It is advantageous that the coupling members are part of the respective supporting members.

Preferably, the outer skins are configured to form the coupling members at opposite ends of the panel.

More preferably, the passage and the outer skins define a subsidiary space filled with the insulating material.

It is preferable that the sidewall is connected to a ceiling.

More preferably, at least one of the floor, the ceiling, the sidewall includes two or more members foldable relative to one another.

Advantageously, the ceiling includes a first ceiling member movably connected to a second ceiling member, relative movement between the first and second ceiling member allow the ceiling to change between expanded and retracted states.

More advantageously, the first and second ceiling members are pivotally connected to each other.

Yet more advantageously, the floor includes a first floor member movably connected to a second floor member, relative movement between the first and second floor member allow the floor to change between expanded and retracted states.

Preferably, the first and second floor members are pivotally connected.

More preferably, the sidewall includes four sidewall members, two of the sidewall members are movably connected to at least one of the two other sidewall members such that relative movement between the sidewall members allows the sidewall to change between expanded and retracted states.

It is preferably that the frame includes frame members that are removably connected to each other for offering mechanical reinforcement.

Advantageously, the frame includes upper frame members and lower frame members connected by inter-connecting frame members.

More advantageously, the ceiling member is supported by the upper frame members, the floor members are supported by the lower frame members and the sidewall is supported by the inter-connecting frame members.

Yet more advantageously, any one of the frame members is movably connected with another frame member so as to allow relative movement between these frame members when the compartment changes between the collapsed and expanded states.

BRIEF DESCRIPTION OF DRAWINGS

The invention will now be more particularly described, by way of example only, with reference to the accompanying drawings, in which.

DETAILED DESCRIPTION OF PREFERRED EMBODIMENT

Figure 1:
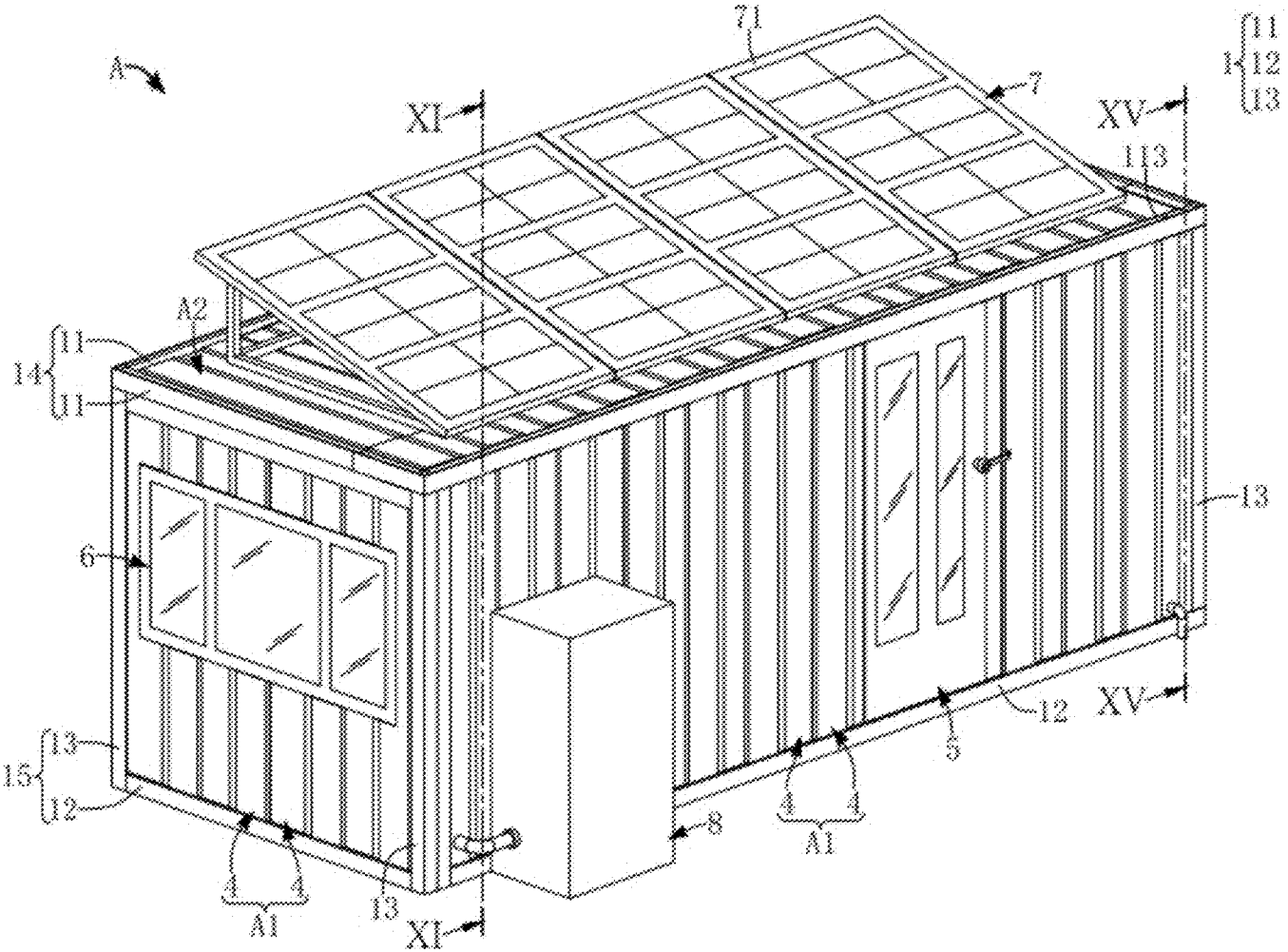
FIG. 1 is a perspective view of a first embodiment of a collapsible living compartment according to the invention.
Figure 2:
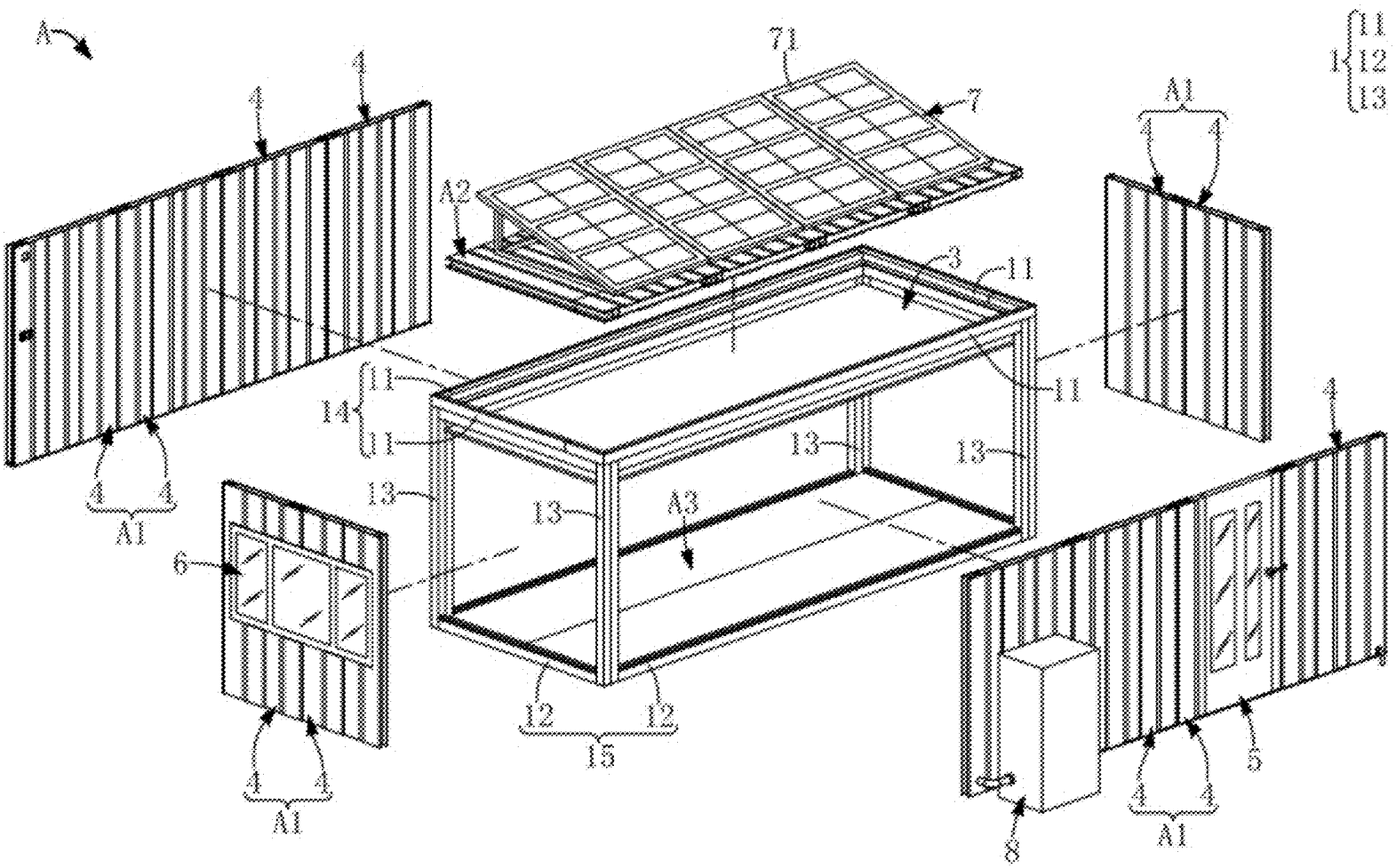
FIG. 2 is an exploded view of the collapsible living compartment in FIG. 1.

Referring to FIGS. 1 and 2, there is shown a first embodiment of a collapsible living compartment 100 for human habitation. The collapsible living compartment 100 is preferably collapsible to a compact state for transportation and can be assembled or expanded to create a closed space of reasonable size sufficient as a sheltered living area.

The collapsible living compartment A includes a main frame 1 supporting a ceiling panel 3, a plurality of panels 4, a door 5, a window 6, a solar electric system 7 and an energy storage 8. In a different embodiment, the collapsible living compartment 100 may not include a ceiling 3.

The frame 1 is mainly to support the collapsible living compartment A. The main frame 1 may be secured to a plurality of base seats on the surface on which the collapsible living compartment A is placed. The main frame includes a plurality of upper frame members 11, a plurality of lower frame members 12 and a plurality of inter-connecting frame members 13. The upper frame members 11 are interconnected to form the upper frame 14. The plurality of lower frame members are interconnected to form the lower frame 15. The plurality of inter-connecting frame members 13 are vertically displayed and each has two opposite ends for connecting with the upper and lower frames 14 and 15 respectively. In an embodiment of the invention, the upper frame 11, the lower frame 12 and the interconnecting frame members 13 are made of steel and they are connecting via welding and/or fastener, coupler such as a rivet.

The ceiling panel 3 is connected to the main frame 1 via light weight steel frames. The frame 1 and the plurality of ceiling panel 3 are secured to one another via conventional means.

A space SP1 and a space SP2 are defined by the ceiling panels 3 and the main frame 1. Together with the floor A3 and the sidewalls A1, the ceiling defines a living space SP2. Space SP1 accommodates a portion of a lighting system, a part of the air conditioning device, all types of pipelines and tubing (e.g. electric and water) and wirings. SP2 is the space for habitation. The Space SP2 is connected with the external environment via SP1. The air conditioning system, wiring and pipes supply SP2 by running through SP1.

A plurality of panels 4 are fixed to the main frame 1. The ceiling A2, the floor A3 and each sidewall A1 are collections of inter-connected panels 4. A door 5 is provided with one of the panels 4 and a window 6 is provided with another panel 4. The number of doors 5 and windows 6 applied will depend on needs. The gap between the door 5 or the window 6 and the respective panel 4 is filled by waterproof material. The door 5 and the window 6 are preferably made of Glass fiber reinforced thermosetting plastic sheet molding material (SMC, Sheet molding compound), Window 6 may include metal parts for mechanical reinforcement.

The solar electric system 7 includes at least one solar panel 71 electrically connected to a circuit 72 both located at the ceiling A2. The circuit 72 includes an energy storage, a variable frequency drive and any other electric component as required. The circuit 72 is connected to an energy storage device 8 which is useful in storing energy collected by the solar electric system 7.

With reference to FIGS. 3 to 8, each panel 4 includes two supporting members 41, two outer skins 42 formed from glass fiber reinforced thermosetting plastic sheet molding material (SMC Sheet molding compound) two passages 43 and a foam body 44 made of PU foam. The two supporting members 41 is the main mechanical support of the panel 4. In more detail, the two support members 41 are provided at respective opposite end portions of the panel 4 to offer mechanical support. These support members 41 are elongated members that runs along height of the panel 4 with a quadrilateral cross-sectional shape when taken across its length. To offer mechanical support these support members are made from relatively hard materials such as wood and metal (steel) etc. The two outer skins 42 are affixed to opposite sides of the two supporting members 41. Such that the two supporting members 41 are sandwiched between the two outer skins 42. Each outer skin 42 is affixed to the same sides of two supporting member 41. The sides to which the outer skins 42 are attached are opposite one another. In the preferred embodiment, the two outer skins 42 along with an inner side of each passages 43 define a subsidiary space in the space 45 which is filled with PU foam to form the foam body 44. The outer skins 42 are held in position with the supporting members 41 by the PU foam 44.

In a preferred embodiment as shown in FIGS. 3 to 8, the passages 43 are provided on an interior side of each supporting members 41. These passages 43 are provided external of the subsidiary space but within the space 45 and sandwiched by the two outer skins 42. The passages 43 are elongated hollow tubing and may be with circular or quadrilateral cross-sectional shape when take across their length. These tubing 43 may be made of plastic or steel and adhesively affixed to the respective supporting members 41. The foam 44 in the subsidiary space 46 when solidified offers mechanical support and assists in fixing the relative positions of the outer skins 42, the passages 43 and the support members 41.

Figure 5:
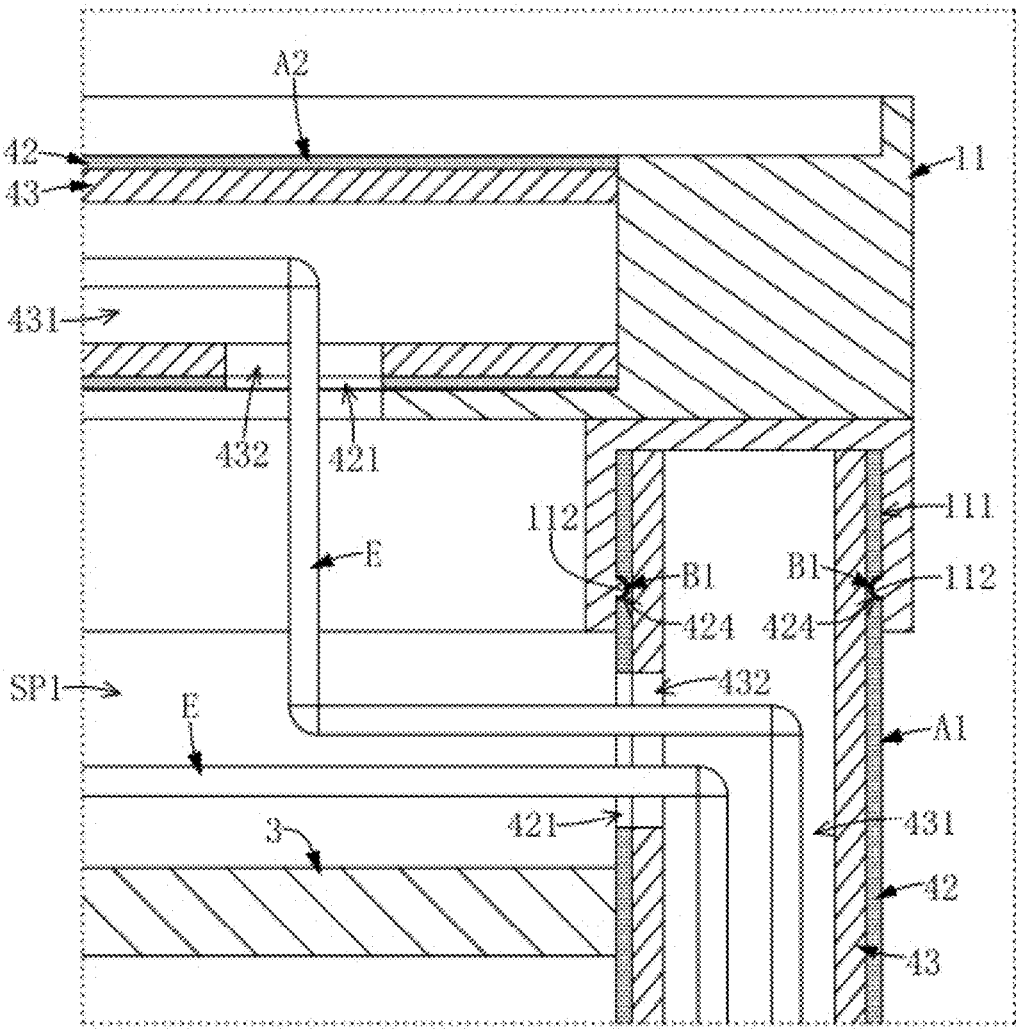
FIG. 5 is an enlarged view of portion XII of the collapsible living compartment in FIG. 4.

As shown in FIG. 5, the passage 43 includes a hollow interior 431 that is in fluid communication with those of other passages 43 and/or the external environment via opening 432 and opening 421. The opening 432 is provided on the passage 43 while the opening 421 is provided on one of the two skins 42. In this embodiment, the openings 432 and 421 overlap with each other and in alignment. The degree of overlapping may be adjusted to control the degree of communication between the passages and the external environment.

Figure 4:
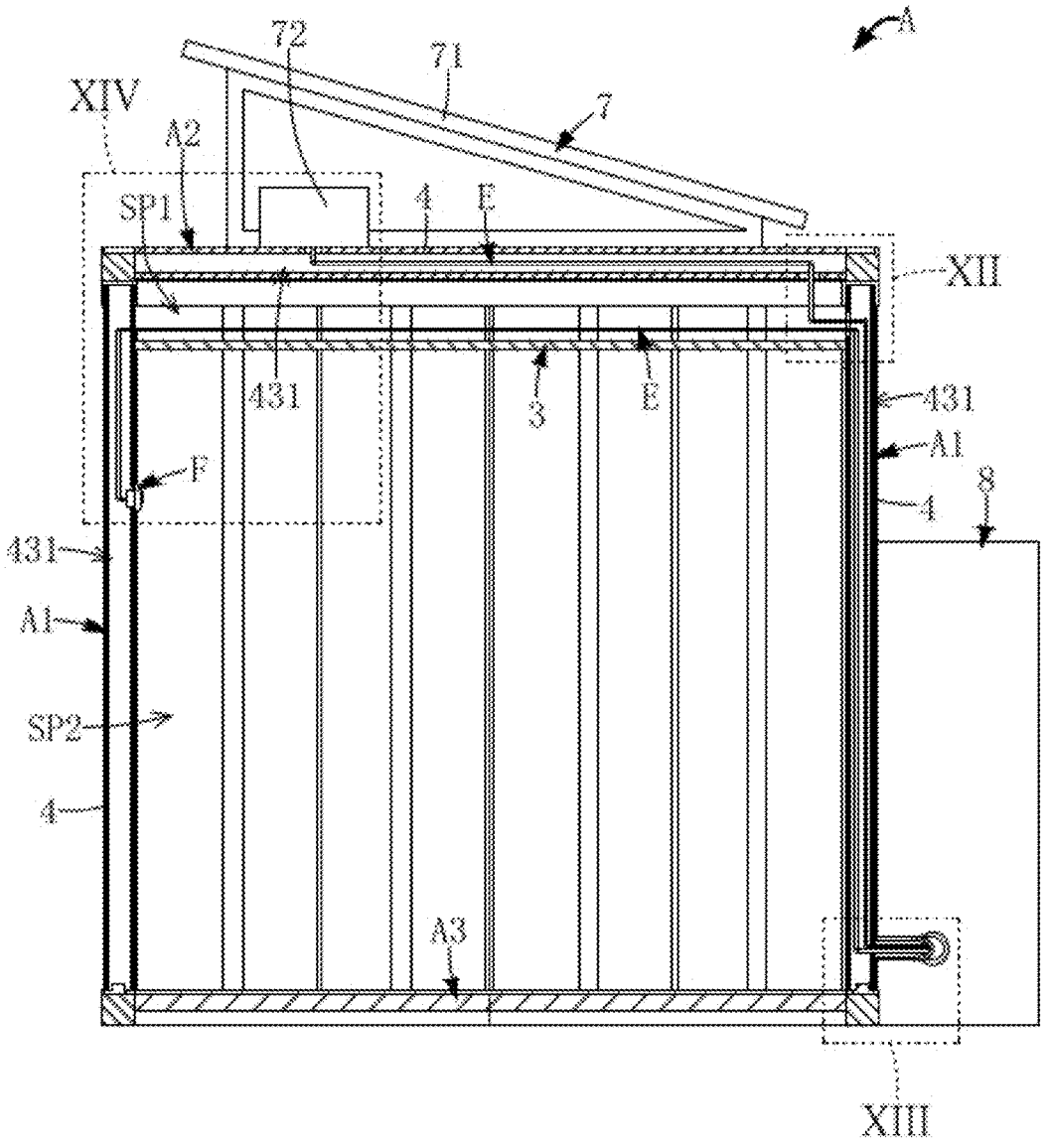
FIG. 4 is a cross-sectional view of the collapsible living compartment taken along line XI-XI in FIG. 1.

With reference to FIGS. 4 and 5, the passage 43 of the panel 4 in the ceiling A2 and that in the panel 4 on the sidewall A1 are in fluid communication via the SP1. Electric wire E and pipelines enters the SP1 via the openings 432 and 421 on the panel 4 of the ceiling A2 and leaves the SP1 via the openings 432 and 421 of the panel 4 of the sidewall A1.

Figure 6:
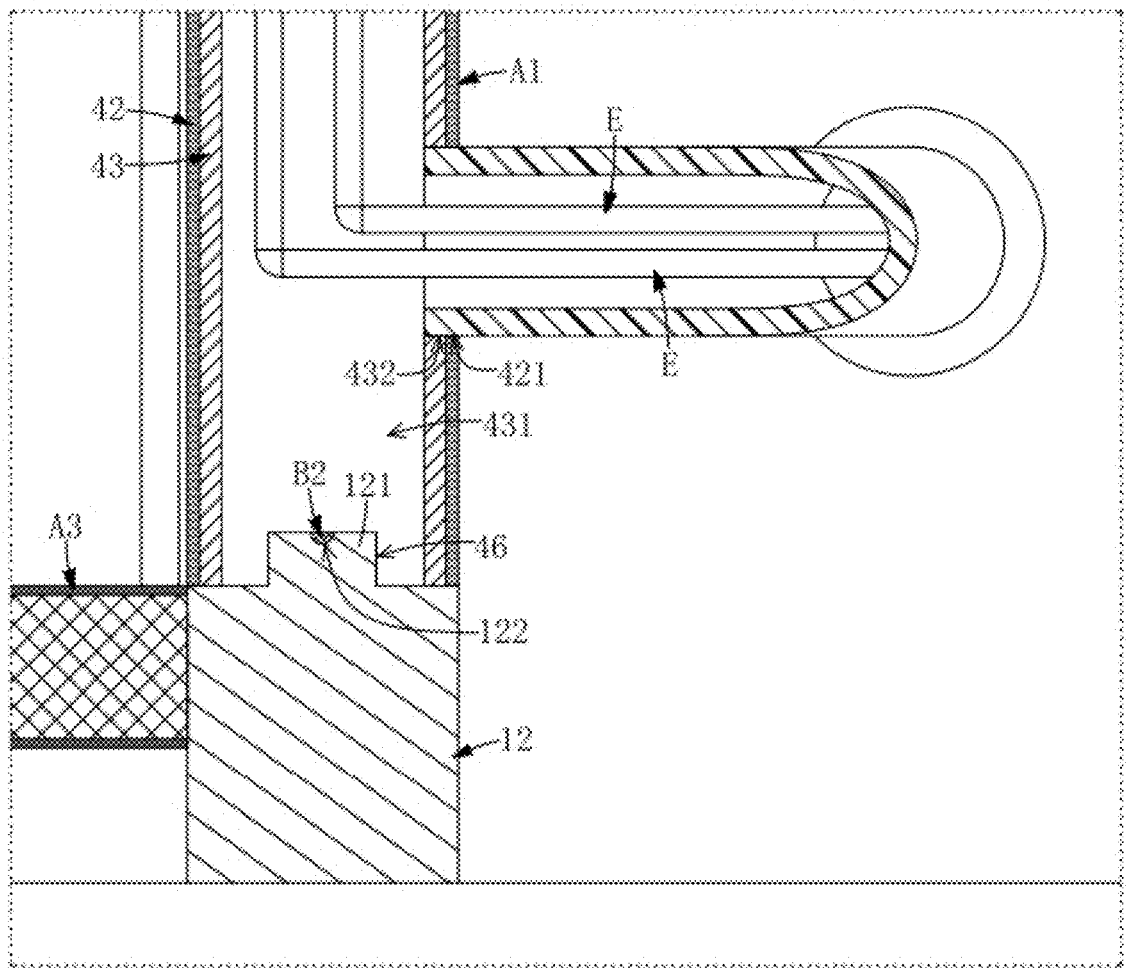
FIG. 6 is an enlarged view of portion XIII of the collapsible living compartment in FIG. 4.

With reference to FIGS. 4 and 6, the hollow interior 431 of the passage 43 is in fluid communication with the energy storage 8 via a further opening 432 on the hollow interior 431 and a further opening 421 on another one of the two outer skins 42 which overlap with the further opening 432. The electric wire E exits the sidewall A1 to connect with the energy storage 8 via the further openings 432 and 421.

Figure 7:
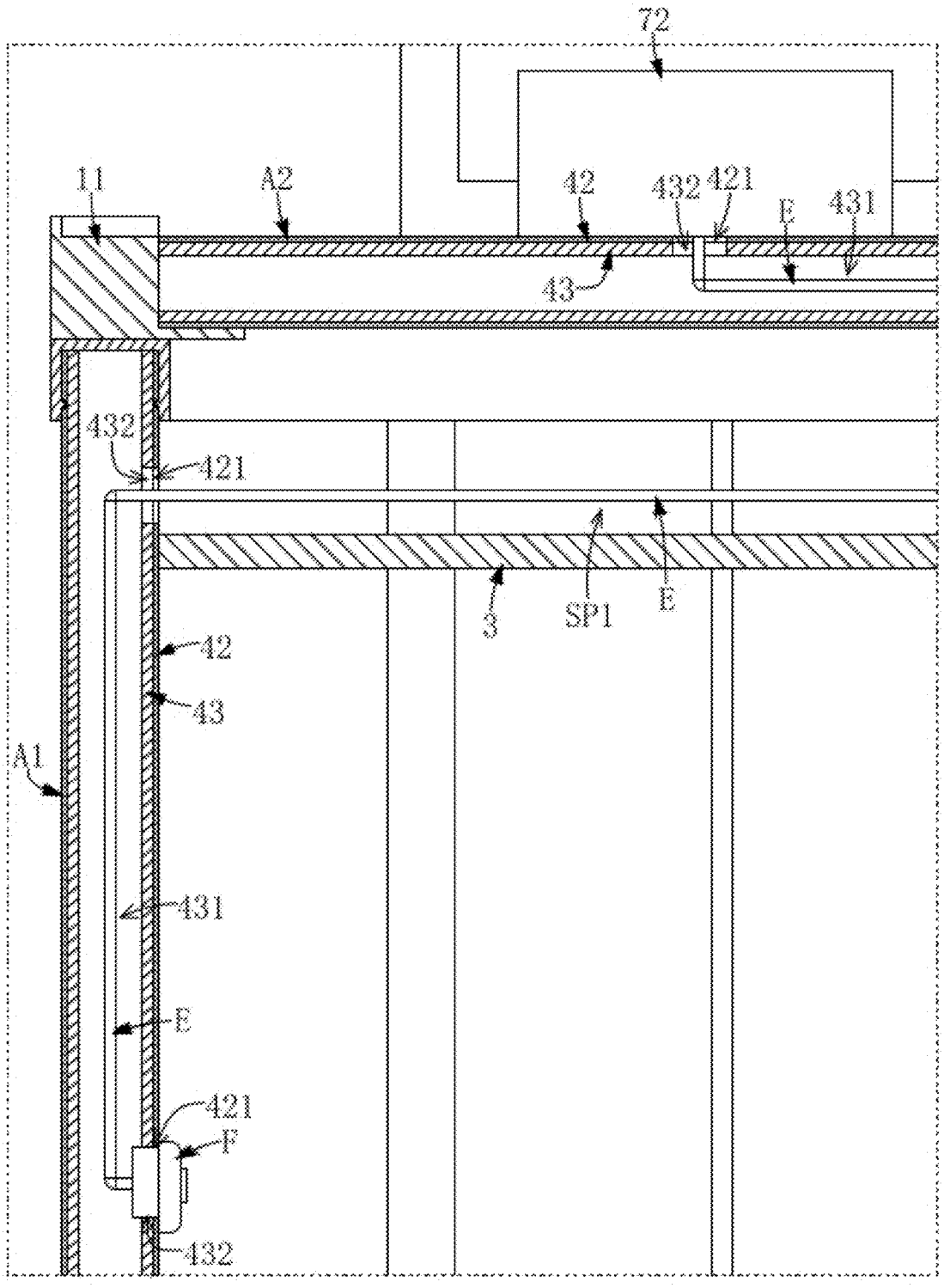
FIG. 7 is an enlarged view of portion XIV of the collapsible living compartment in FIG. 4.

With reference to FIGS. 4 and 7, the hollow interior 431 of the passage 43 in the panel 4 of the ceiling A2 is in fluid communication with the circuit 72 of the solar energy system 7 via further openings 432 and 421 of the passage 43 and the skin 42. The electric wire E is in connection with the circuit 72 via these further openings 432 and 421. The electric wire E runs through the SP1 to enter the hollow interior 431 of 5 the passage 43 in one of the panels 4 of the sidewall A1 via the openings 432 and 421 as shown in FIG. 7. The electric wire E is in connection with a socket F affixed to a further opening 432 and 421 of the relevant passage 43 and skin 42. This further openings 432 and 421 on the outer skin 42 are open to the space SP2.

The solar energy system 7 is in connection with the socket F and the energy storage 8 via the hollow interior 43, the space SP1, the various openings and further openings 432 and 421 on the passages 43 and the outer skins 42 of the panels 4. They avoid the exposure of the wiring and pipelines by allowing them to run inside the panels 4. This is a safety measure as well as a substantial improvement on the esthetic appearance of the collapsible living compartment comparing to what is available in the market.

Conventional collapsible living compartments are built from metal plates without heat or sound insulation. Also the same metal plates are not intended for reassembling after being disassembled. The compartments 100 are not intended for transportation. Wirings and pipes are exposed which causes safety concerns. The collapsible living compartment A of the invention have strong heat and sound insulation attributable to the foam 44 and the use of sheet molding components. The light weighted metal door and windows lowers the overall weight of the compartment A for easy transportation. The wirings and pipes run in designated and enclosed space for protection. The reversible couplings that link all the panels 4 offer flexibility.

With reference to FIGS. 5 and 6, the upper frame member 11 is coupled to an upper end of the panel 4 via a first coupler and the lower frame member 12 is coupled to the lower end of the panel 4 via a second coupler. The first coupler requires each of the upper frame members 11 to include a retainer 111 which can be in the form of a groove for accommodating an upper end of each of the panels 4 connected thereto. Inner wall of retainer 111 is in mechanical connection with the upper end of the panels 4 via a pair of locking members 112/424. In an embodiment as shown in FIG. 5, the pair of locking members 112/424 includes a pair of projections or bumps 112 on at least two sides of an inner wall of the retainer 111, which can be fitted into respective receiving dents or grooves or depressions 424 on the skins 42 of the upper end of each panel 4. Plastic or adhesive may be applied to the dent 424 before the fitting of the projection or bump 112. Also waterproof plastic structure B2 is inserted between the dent 424 and the projection 112 to form a waterproof connection. The second coupler requires the lower frame members 12 to include a retainer 121 which can be in the form of a protrusion 121 to be accommodated in a groove or dent 46 on the lower end of the panel 4. The protrusion 121 may include a dent or a depression or groove 122 for holding adhesive of molten plastic for gluing the lower end of the panel 4 to the lower frame member 12. Waterproof structure B1 is inserted into the dent 122 to form a waterproof connection.

The dimension of the groove 111 may be slightly smaller than that of the upper end of the panel 4 while the groove 46 on the lower end of the panel 4 may be dimensioned slightly smaller than the protrusion 121 so as to ensure a tight fit in the first and second couplers.

Figure 8:
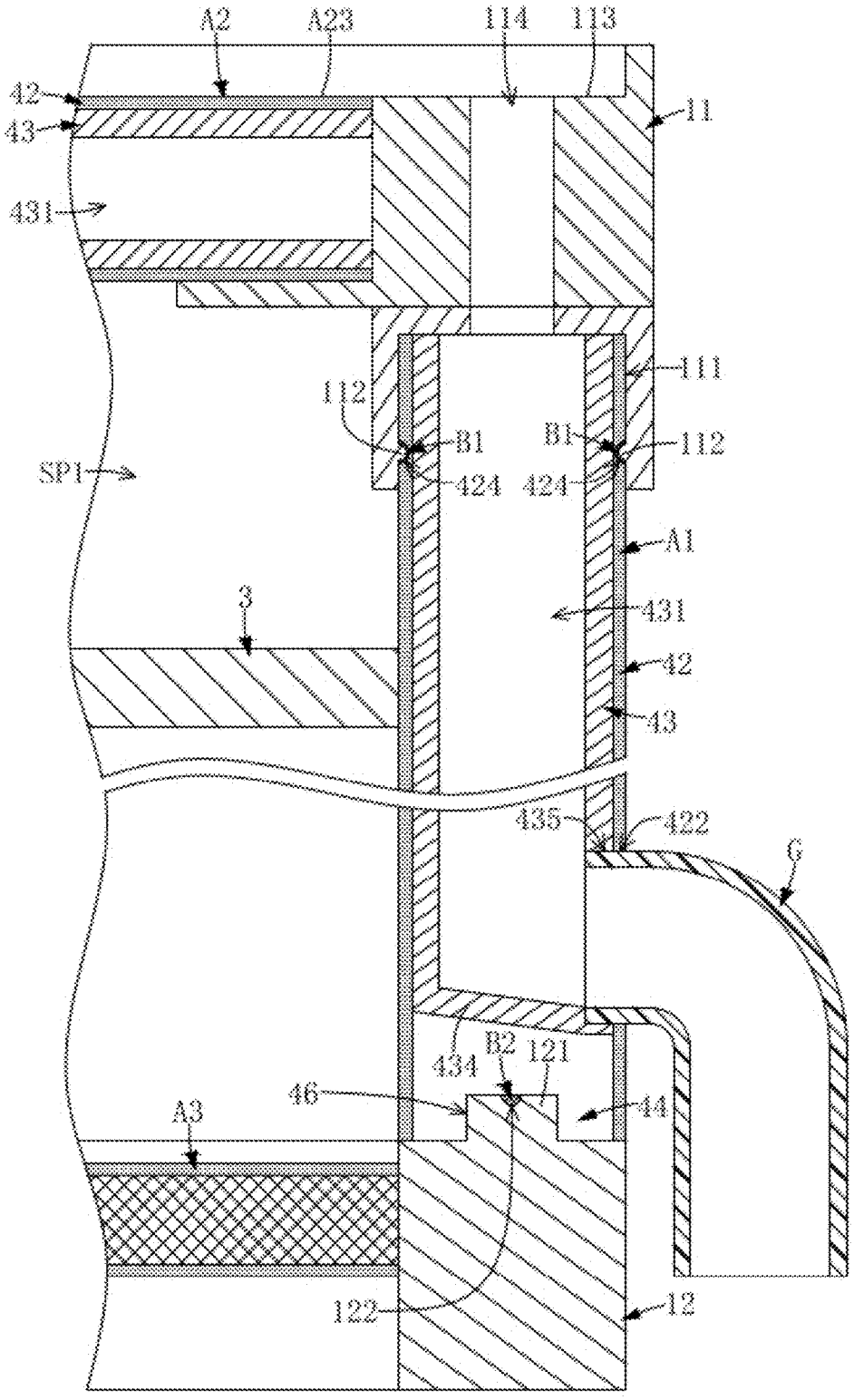
FIG. 8 is a cross-sectional view of the collapsible living compartment taken along line XV-XV in FIG. 1.

With reference to FIGS. 1 and 8, the passage 43 of one or more of the panels 4 in the sidewall A1 includes a slanted end wall 434 leading to a lower opening 435 at the lower end portion. The slanted end wall 434 is tilted towards an outlet tube G that leads to outside of the collapsible living compartment 100. The outlet tube G is connected to the passage 43 via an opening 422 on the skin 42 of the panel 4 and the opening 435 on the passage 43. These openings 422 and 435 are aligned to define an aperture through which liquid that travels through the passage 43 can be lead out of the collapsible living compartment 100 via the outlet tube G.

The ceiling A2 is slightly titled towards a guide surface 113 and a water outlet 114 of the frame 11. The outlet 114 cuts through the frame 11. The ceiling A2 along with the guide surface 113 leads any fluid such as rain deposited on the ceiling A2 towards the water outlet 114. The water is guided by the slightly tilted ceiling A2 and the guide surface 113 towards the outlet 114 then down a designated passage 43 towards the outlet tube G via the slanted end wall 434.

The passages 43 of the panels 4 in the sidewalls A1 through which the wire run are different from the passages 43 for directing fluid or water from the ceiling A2 away from the collapsible living compartment A.

Figure 9:
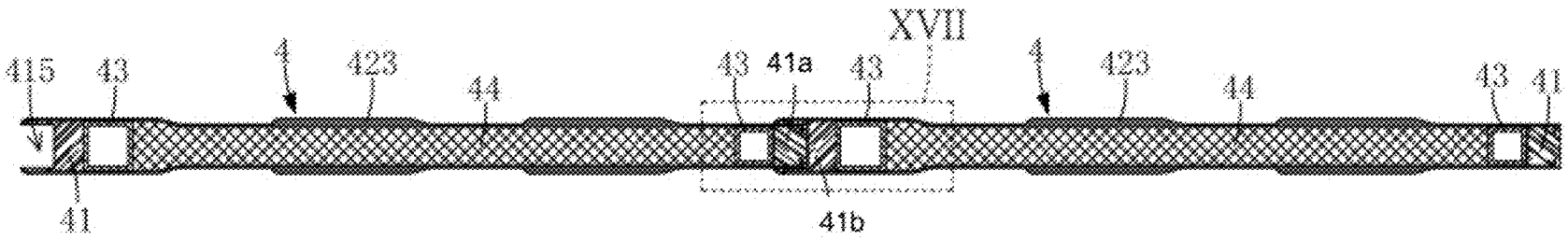
FIG. 9 is a top plan view of two panels of the collapsible living compartment in FIG. 1, showing a first embodiment of a coupler coupling the two panels.
Figure 10:
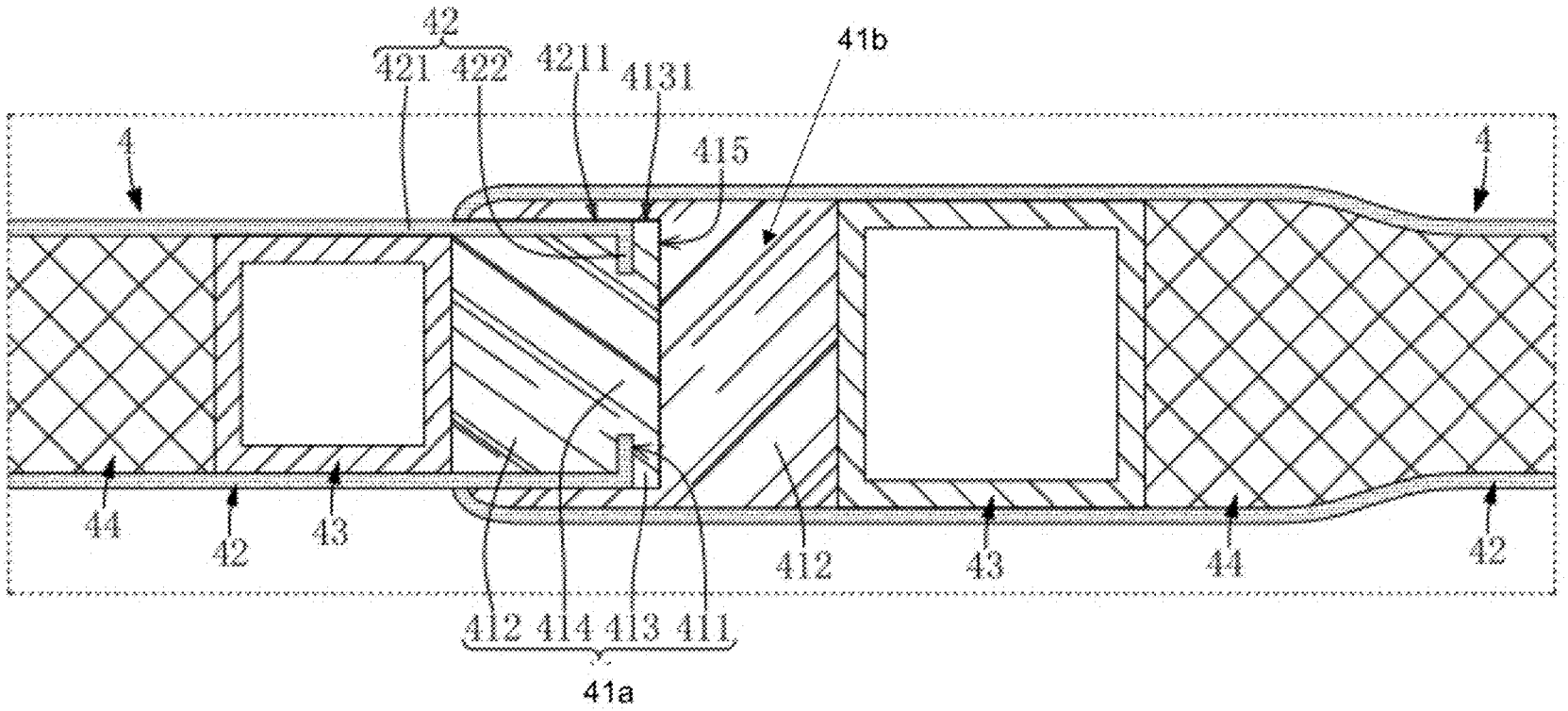
FIG. 10 is an enlarged view of portion XVII of the collapsible living compartment in FIG. 9.
Figure 11:
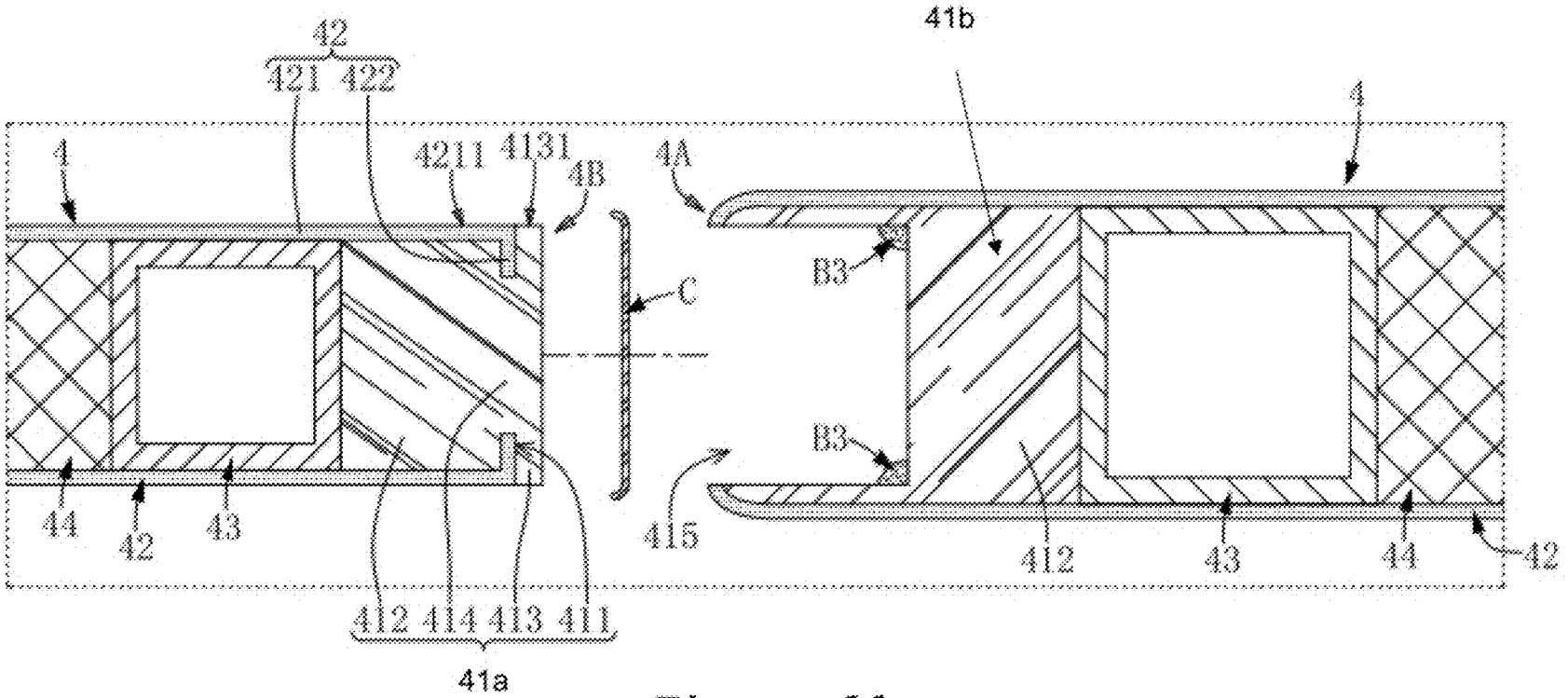
FIG. 11 is an exploded view of the portion XVII in FIG. 10.

Now turning to FIGS. 3, 9 to 11. As mentioned, each panel 4 has two end portions. With reference to FIGS. 10 and 11, the first end portion includes a first support member 41*a* partially sandwiched by the outer skins 42. The outer skins 42 each includes a main body 421 and an extension 422 arranged transversely thereto. These extensions 422 are accommodated by the first support member 41*a* which may include two retainers in the form of grooves 411 one on each of two opposite sides for insertion of the respective extensions 422. Adhesive may be applied between the extension 422 and the grooves 411 for reinforcement. More specifically, the first support member 41*a* includes a main portion 412 and an auxiliary portion 413 connected by a connector portion 414. The thickness of the main portion 412 and the auxiliary portion 413 is greater than that of the connector portion 414. The two grooves 411 are provided at the connector portion 414. The width of the auxiliary portion 413 is dimensioned so-as-to flush with outer skin 42 that covers the main portion 412 and the connector portion 414. The second end portion includes a second support member 41*b* positioned next to the relevant passage 43. In the embodiment as shown in FIGS. 9 to 11, the second support member 41*b* is completely sandwiched between the outer skins 42 and includes a retaining member 415 in the form of a groove or a slot.

As can be seen from the drawings, the width of the second end portion D1 is greater than that of the first end portion D2. The connection between two consecutive panels 4 is an end-to-end connection. As D1 is larger than D2, the first end portion can be inserted into the second end portion and to be retained by the retaining member 415. The first support member 41*a* and the second support member 41*b* collectively form the support structure 41 of the panels 4. With reference to FIGS. 9 and 10, the passage 43 at the first end portion is smaller in dimension than the passage 43 in the second end portion.

Referring to FIG. 11, when connecting two panels 4, a layer of adhesive C is applied to the first end portion of the first panel 4A and water-proof material B3 is injected into two inner corners of the retaining member 415 of the second end portion of the second panel 4B. The first end portion is then inserted into the retaining member 415 with the layer of adhesive C engaging the water-proof material B3. The connection of the two panels 4A and 4B is completed when the water-proof material B3 dries off. The water-proof material B3 prevents water from entering the space SP2 via the connection between the panels 4.

Figure 3:
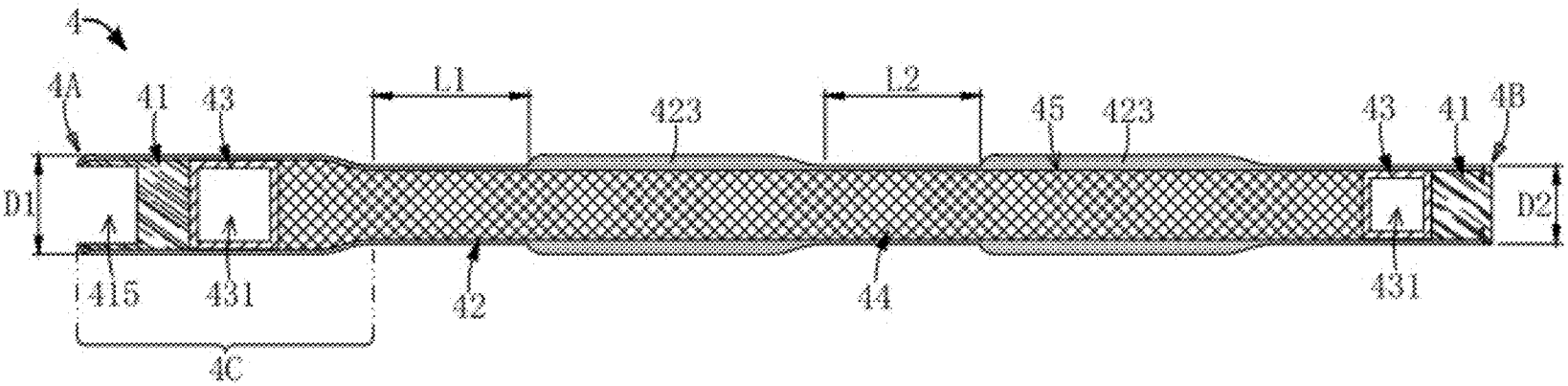
FIG. 3 is a top plan view of a panel of the collapsible living compartment in FIG. 1.

With reference to FIG. 3, the two outer skins 42 of a panel 4 has corresponding and evenly spaced decorative portions 423. External appearance of the second end of the panel 4 resembles the part of the panel 4 with decorative portions 423. The decorative portions on each outer skin 42 is evenly spaced at a distance of L2 while the second end portion is separated from its adjacent decorative portions 423 by a distance of L1. The sidewall A1 has a wavy external appearance.

Figure 12:
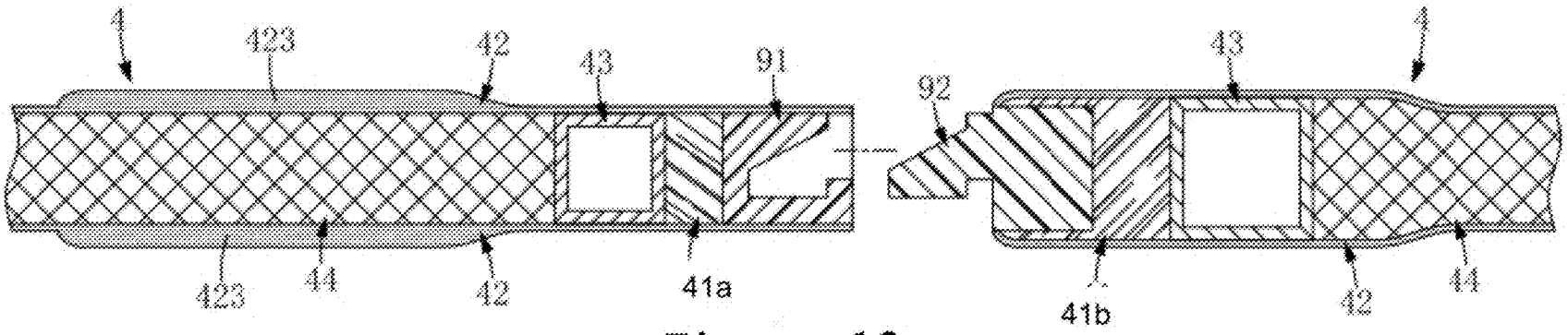
FIGS. 12 and 13 are top plan view of a portion of two panels showing a second embodiment of a coupler coupling the two panels.
Figure 13:
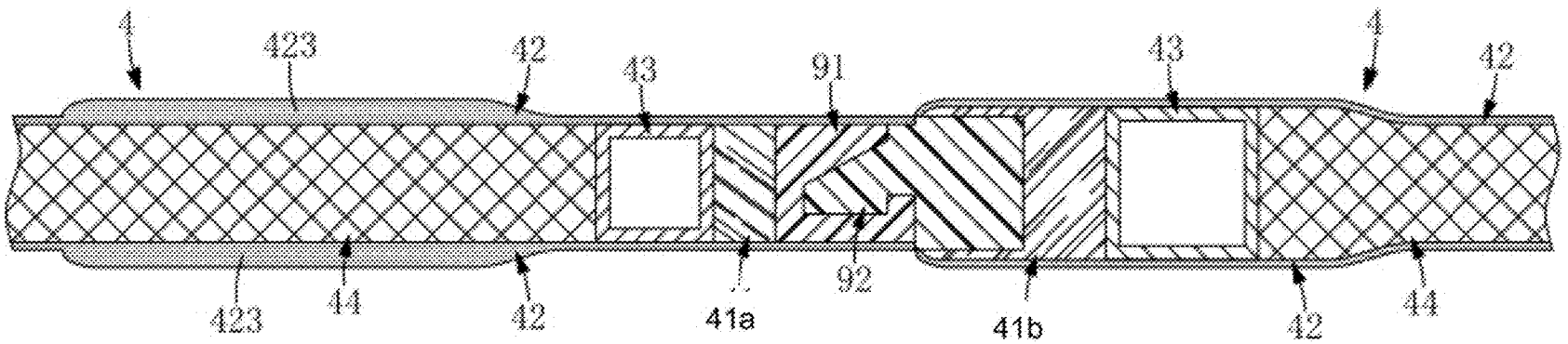

Referring to FIGS. 12 and 13, there is shown a second embodiment of the panel 4 where the second end portion includes a specifically shaped protrusion 92 extending from second support member 41*b* and the first end portion includes a retainer with a complementary shaped recess 91 provided adjacent the first support member 41*a*. The protrusion 92 of a first panel 4A is fitted with the recess 91 of a second panel 4B so-as-to form a lock for securing the two panels 4A and 4B in place as shown in FIG. 13. The shape of the protrusion 92 and the recess 91 may be of any shape that is useful in securing the two panels 4A and 4B together. Water-proof material may be applied at the junction where the protrusion 92 and the recess 91 connects to form a waterproof connection.

Figure 14:
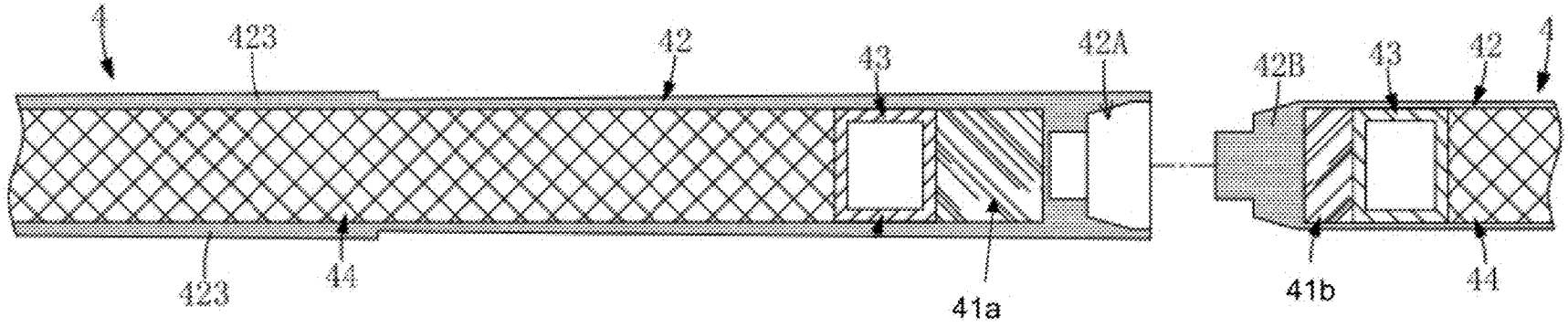
FIGS. 14 and 15 are top plan view of a portion of two panels showing a third embodiment of a coupler coupling the two panels.
Figure 15:
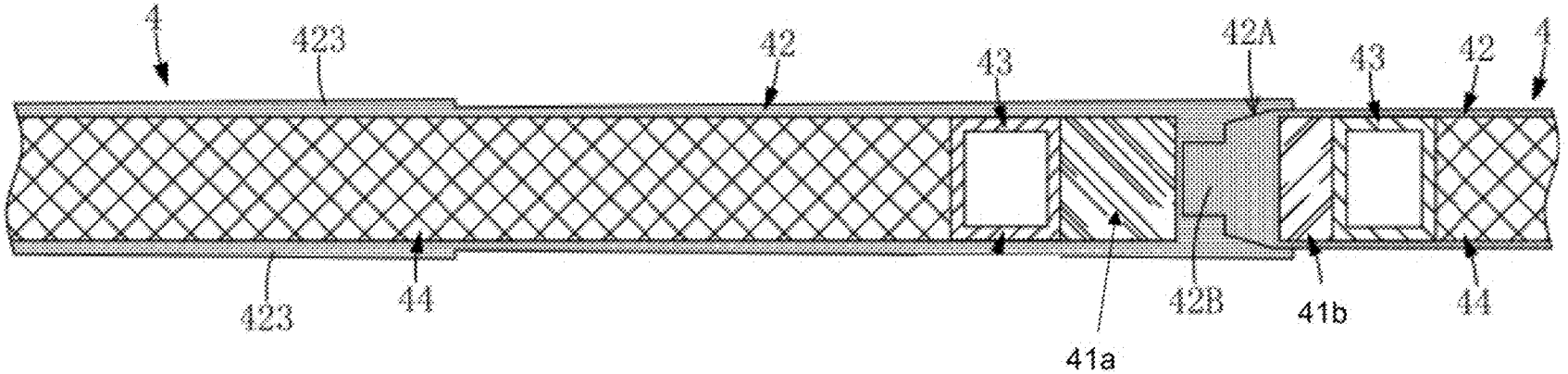

With reference to FIGS. 14 and 15, there is shown a third embodiment of the panels 4, the first and second end portions have the same width. The outer skin 42 of the first end portion extends to form a retainer 42B in the form of a shaped recess positioned adjacent to the support member 41. In other words, the retainer 42B is integrally formed with the skin 42 as one piece. In the second end portion, the outer skin 42 extends to form a complementarily shaped projection 42A for fitting into a corresponding retainer 42B of a different panel 4. The retainer 42B and the projection 42A are both located next to corresponding support member 41. Waterproof material may be applied at the junction where the projection 42A and the retainer 42B are connected to form a waterproof connection. The retainer 42B and the projection 42A forms complementary coupling members of a coupler that couples adjacent panels 4A and 4B. The shape of the complementary coupling members can be adjusted according to needs and are formed with the outer skin 42 in a same molding step. In the third embodiments of the panel 4, the width of the first and second end portions are generally the same.

FIGS. 16 to 22 show a second embodiment of the invention The collapsible living compartment A100 in the second embodiment includes foldable ceiling A2 and floor A3. the sidewall A1 may be configured to be foldable if needed. The collapsible living compartment A100 includes sidewalls A1 connecting a ceiling A2 and a floor A3. There are a number of doors 5 and windows 6. The sidewall A1 includes four wall structures, front and rear sidewalls A11 and A12 connected by left and right sidewalls A13 and A14. The front and rear sidewalls A11 and A12; and the left and right sidewalls are arranged opposite to each other. The left and right sidewalls A13 and A14 are movably connected to any one of the front and rear sidewalls A11 and A12. In the embodiment as shown in FIGS. 16 to 23, the left and right sidewalls A13 and A14 are pivotally connected to one of the front and rear sidewalls A11 and A12. In an alternative embodiment, the left and right sidewalls may be pivotally or slidably connected to any of the front sidewall A11, rear sidewall A12, the ceiling A2 or the floor A3. The sidewalls A11, A12, A13, A14 together with the ceiling A2 and the floor A3 define a living space SP2.

In the embodiment as shown in FIGS. 16 to 22, the front, rear, left and right sidewalls A11, A12, A13 and A14 are each provided with a frame member A111, A121, A131 and A141 that collectively form a lower frame member 12 of the main frame 1. These frame members A111, A121, A131 and A141 may be made of metal to offer mechanical support and strength to the respective sidewalls A11, A12, A13 and A14. In more detail, the frame member A131 and the frame member A141 are pivotally connected to the adjacent frame member A121. The left and right sidewalls A13 and A14 are connected to the rear sidewall A12 via one or more pivotable connectors such that both left and right sidewalls A13 and A14 can rotate 270 degrees relative to the rear sidewall A12. When the collapsible living compartment 100 is at a collapsed state, the outer side A133 of left sidewall A13 and the outer side A144 of the right sidewall A14 are placed in close proximity to and overlap with an outer side A123 of the front sidewall A12. The left and right sidewalls A13 and A14 are rotated or pivoted 270 degrees with respect to the rear sidewall A12, the inner sides A132 and A142 of the left and right sidewalls A13 and A14 lie parallel over the outer wall A123 of the front sidewall and be fully exposed.

The ceiling A2 includes a first ceiling member A21 and a second ceiling member A22. At least one dimension of the first ceiling member A21 is smaller than that of the second ceiling member A22. The length of the first ceiling members A21 and A22 are the same while the width of the ceiling member A22 is wider than that of the ceiling member A21.

The first ceiling member A21 is pivotally connected to the front sidewall A11. More specifically, frame member A211 of the first ceiling member A21 is fixedly connected to frame member A111 of the front sidewall A11. The first ceiling member A21 and the second ceiling member A22 are pivotally or rotatably connected such that the second ceiling member A22 is rotatable or pivotable relative to the ceiling member A21. Other than the side for connecting with the second ceiling member A22, the remaining three sides are enclosed by frame member A211. The same applies to the second ceiling member A22, other than the side which connects with the first ceiling member, the rest of the sides are enclosed by frame member A221.

The first and second ceiling members A21 and A22 are pivotally connected by a number of pivotable connectors such that when the collapsible living compartment 100 is at its collapsed state, the second ceiling member A22 is capable of rotating 90 degrees relative to the first ceiling A21 towards the living space SP2 and to be placed on the outer side A132 and A142 of the left and right sidewalls A13 and A14 after they have rotated 270 degrees relative to the rear sidewall A12.

The floor A3 includes first and second floor members A31 and A32 which are pivotally or rotatably connected. The other sides of the first and second floor members A31 and A32 are pivotally or rotatably connected to the front and rear sidewalls A11 and A12 respectively. The first and second floor members A31 and A32 has three sides being provided with frame members A311, A321 that may be made of metal. The frame member A311 is pivotally or rotatably connected to the frame member A111 and the frame member A321 is pivotally or rotatably connected to the frame member A121. Through these pivotal connections, the first and second floor members A31 and A32 can pivot relative to each other and relative to the front and rear sidewalls A11 and A12.

The door 5 and the window 6 are provided on one of the sidewalls A11, A12, A13 and A14. The door 5 and window 6 are made of Fiber Reinforced Plastics FRP. In this embodiment, the door 5 and window 6 are fixedly connected to the sidewall A11, A12, A13 or A14. In another embodiment, these may be removably connected thereto with interchangeable dimension such that the position of the door 5 and window 6 may be changeable according to needs.

When the collapsible living compartment 100 is in the assembled form, as shown in FIG. 1, the front and rear sidewalls A11 and A11, the left and right sidewalls A13 and A14, the first and second ceiling members A21 and A22, the floor A3 together forms the living space SP2. The living space SP2 includes inner side A112 of the front sidewall A11, inner side A122 of the rear sidewall A12, inner side A132 of the left sidewall A13 and inner side A142 of the right sidewall A14 as well as inner side A212 and A222 of the first and second ceiling members A21 and A22 and inner side A312 and A322 of the floor members A31 and A32. outer sides A133, A143 of the front and rear sidewalls A13 and A14, outer sides A213 and A223 of the first and second ceiling members A21 and A22 and the outer side A313 and A323 of the floor members A31 and A32 collectively defines the exterior of the assembled collapsible living compartment 100.

Figure 16:
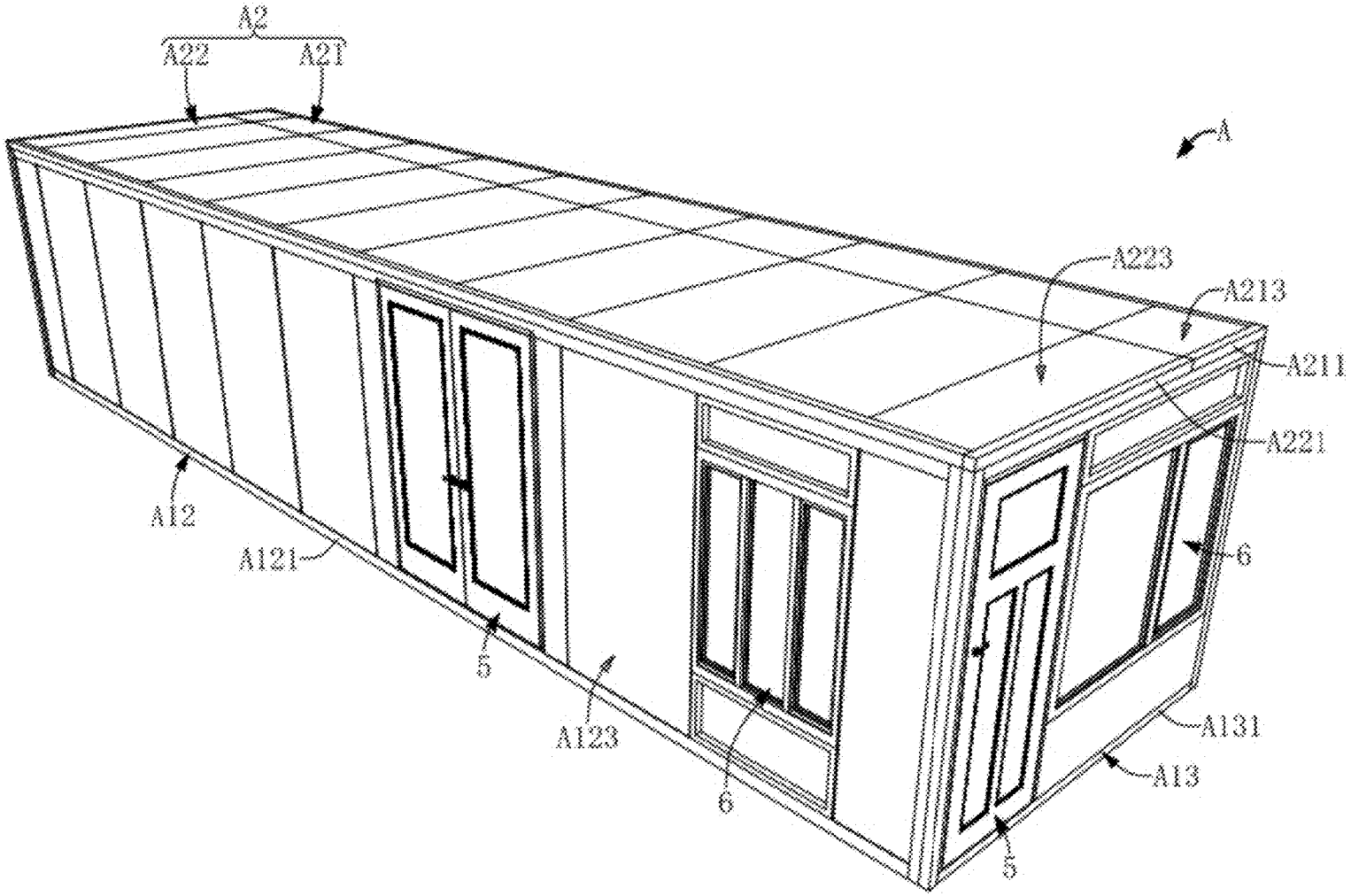
FIG. 16 is a perspective view of a second embodiment of a collapsible living compartment in an expanded state according to the invention.
Figure 17:
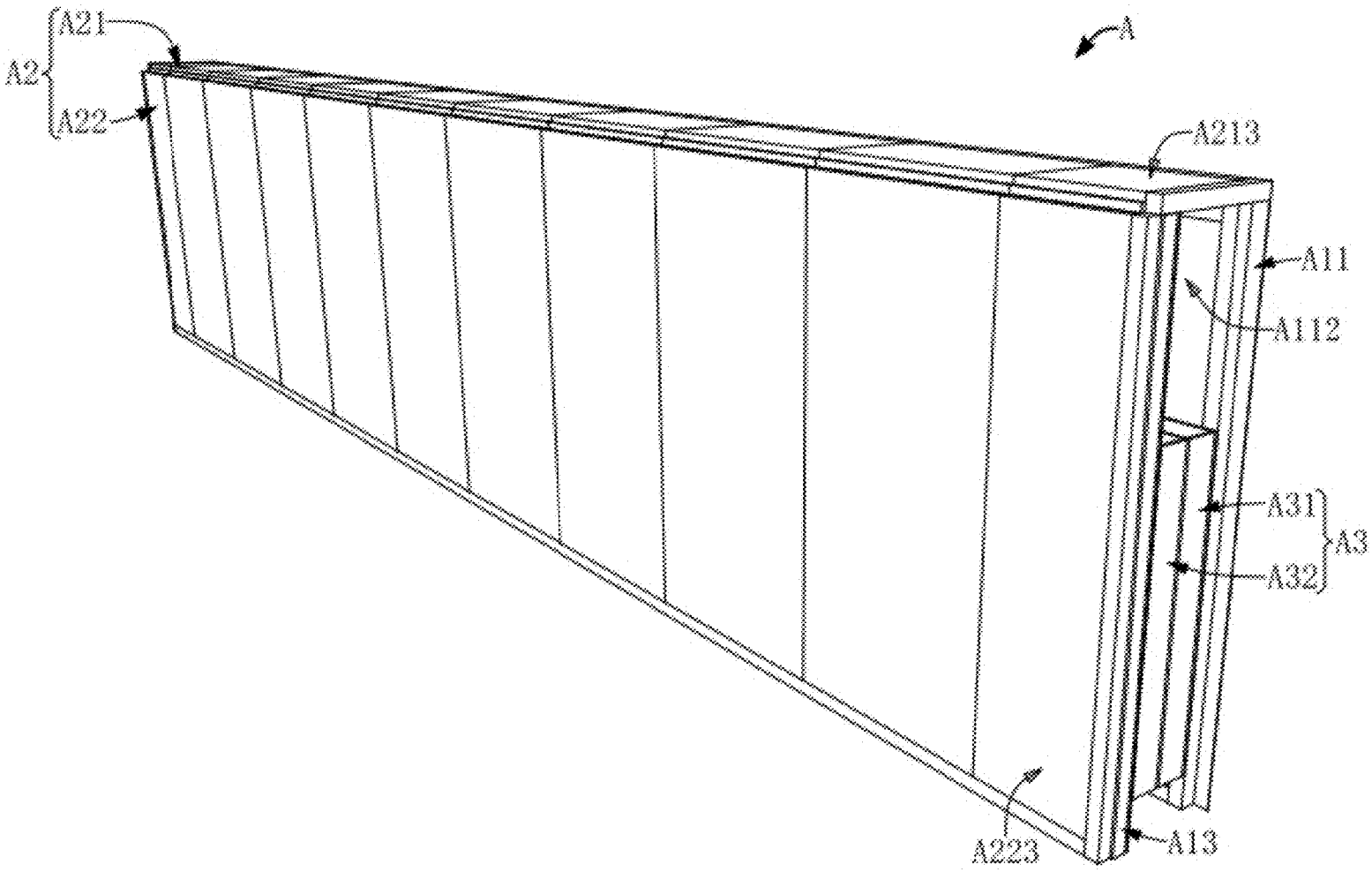
FIG. 17 is a rear perspective view of the second embodiment of the collapsible living compartment of FIG. 16 in a collapsed state.

As shown in FIGS. 16 to 22, this embodiment of the collapsible living compartment 100 can be operated to change between a collapsed state as shown in FIGS. 16 and 17 and an expanded state as shown in FIG. 16. When collapsed, the collapsible living compartment 100 has an overall dimension and space occupancy much smaller than the collapsible living compartment 100 in its expanded state. In the collapsed state, it is most convenient for transportation.

As shown in FIGS. 16 and 17, when the collapsible living compartment 100 is in the collapsed state, the outer surfaces A313 and A323 of the two floor members A31 and A32 are faced towards or arranged against one another. The inner surface A312 of the floor member A31 faces or is arranged against the inner surface A112 of the front sidewall A11. The inner surface A322 of the floor member A32 faces or is arranged against the inner surface A122 of the rear sidewall A12. The outer surface A133 and A143 of the left and right side surfaces A13 and A14 faces or are arranged against the outer surface A123 of the rear sidewall A12. The inner surface A222 of the second ceiling member A22 faces or is arranged against the inner surfaces A132 and A142 of the left and right sidewalls A13 and A14.

Figure 18:
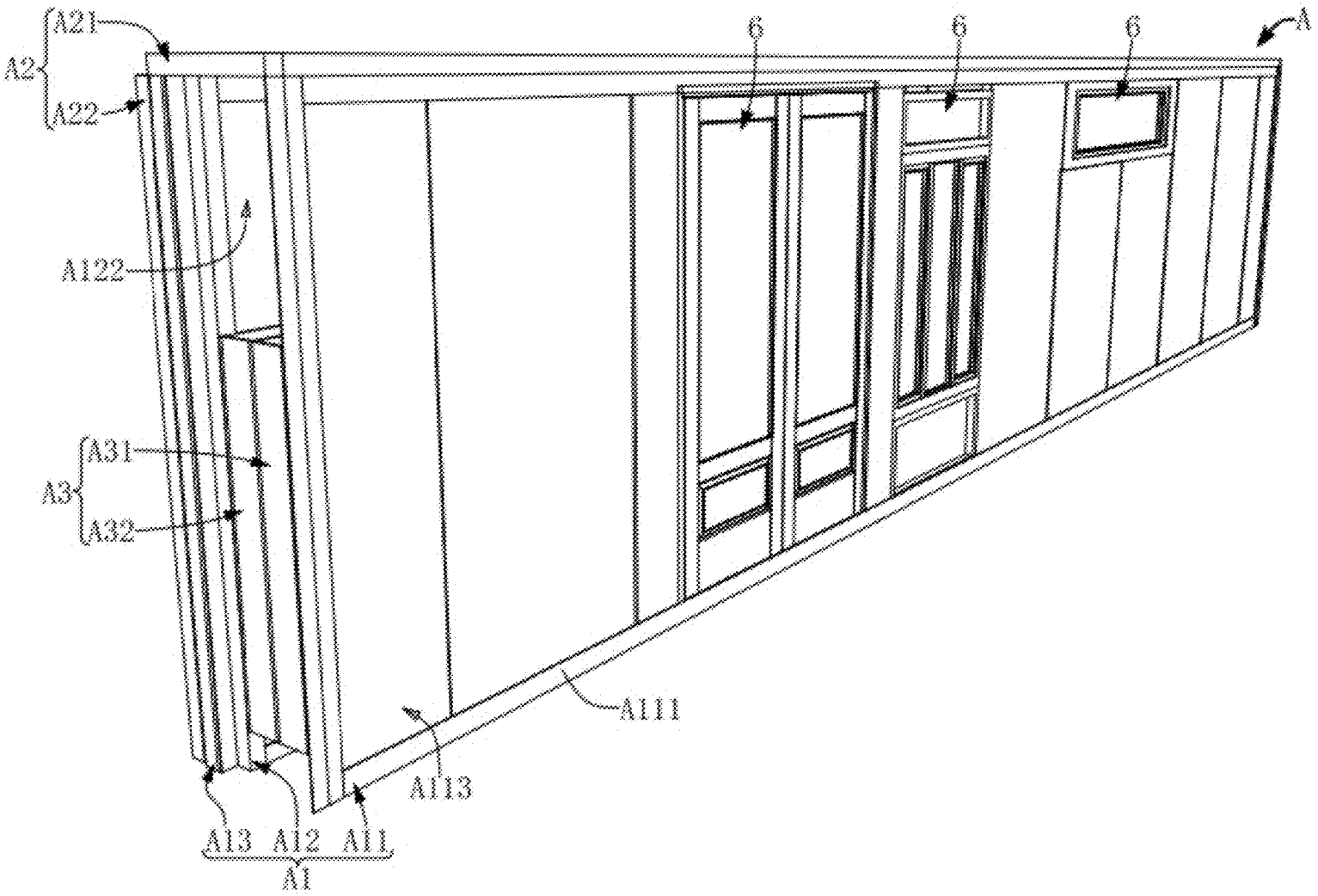
FIG. 18 is a front perspective view of the second embodiment of the collapsible living compartment of FIG. 16 in a collapsed state.
Figure 19:
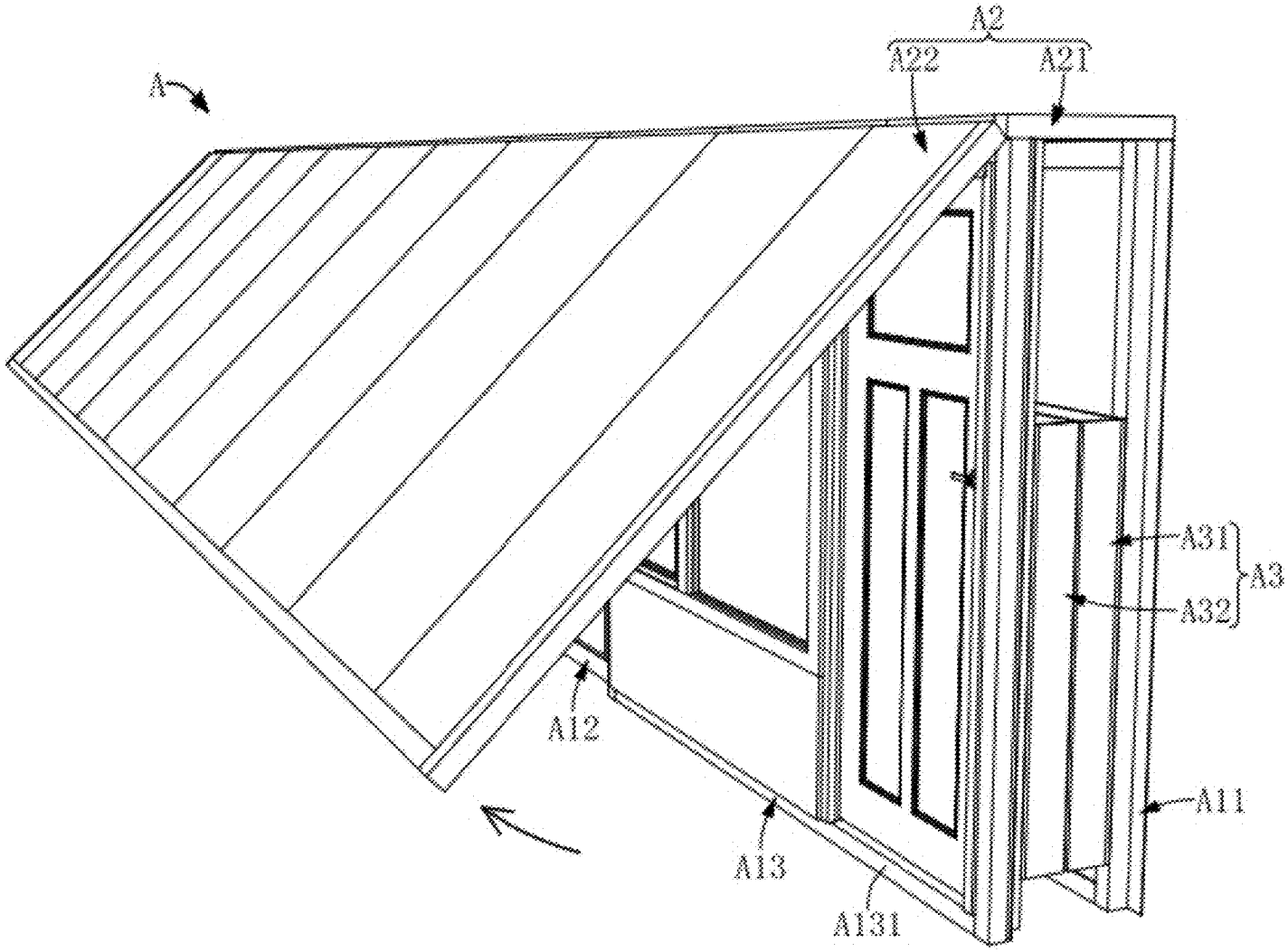
FIG. 19 is the rear perspective view of the second embodiment of the collapsible living compartment of FIG. 17 with a ceiling members in expanding state.
Figure 20:
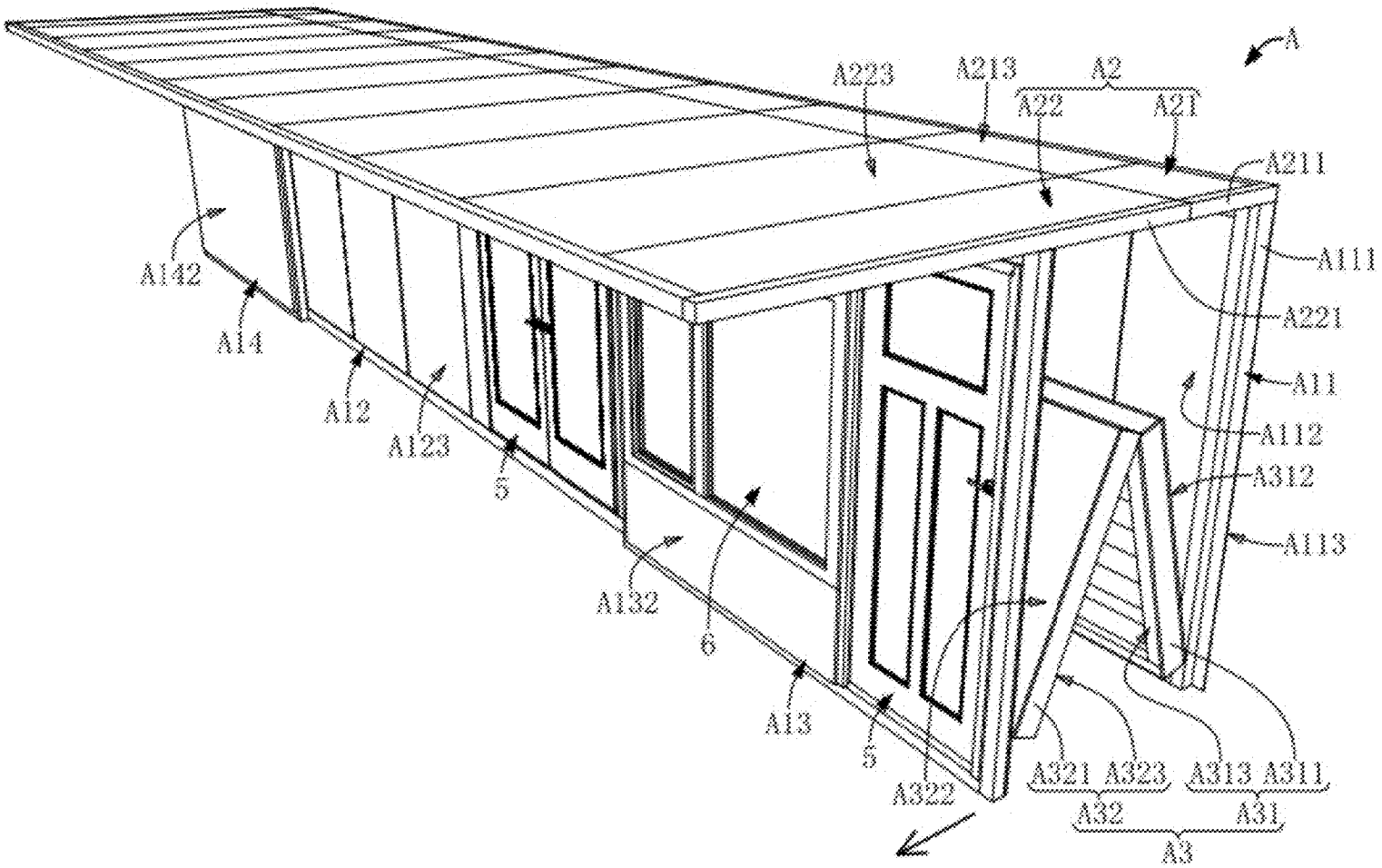
FIG. 20 is the rear perspective view of the second embodiment of the collapsible living compartment of FIG. 17 with a ceiling members in fully expanded state and floor members in expanding state.

As shown in FIGS. 18, 19 and 20, when the collapsible living compartment 100 is in the collapsed state, one way to expand it would be to first rotate the second ceiling member A22 upwards to flush with the first ceiling member A21 and until the outer side A223 of the second ceiling member A22 is aligned with the outer side A213 of the first ceiling member A21. The relative positions of the first and second ceiling members A21 and A22 can be fixed by way of conventional couplers. Thereafter, with reference to FIGS. 22 and 23, the rear sidewall A12 under the second ceiling member A22 can be moved or pulled away from the front sidewall A11 up and until free side A of the rear sidewall A12 is in contact with free side A' of the second ceiling member A22. At the same time, the inner side A312 and A322 of the floor members A31 and A32 will no longer be folded towards one another but gradually move into a flat expanded position. For safety reasons, the second ceiling member A22 can be supported by a crane until the floor members A31 and A32 are in their fully expanded positions. Couplers may be used to secure the frame member A221 of the ceiling member A22 to the frame member A121 of the rear sidewall A12 and to fix the relative positions of the frame members A311 and A321 of the floor members A31 and A32. To assist movements of the various parts, in a preferred embodiment, guides in the form of tracks may be provided on the inner side A222 of the second ceiling member A22 and the free side A of the rear sidewall A12 is connected thereto with or without wheels.

Figure 21:
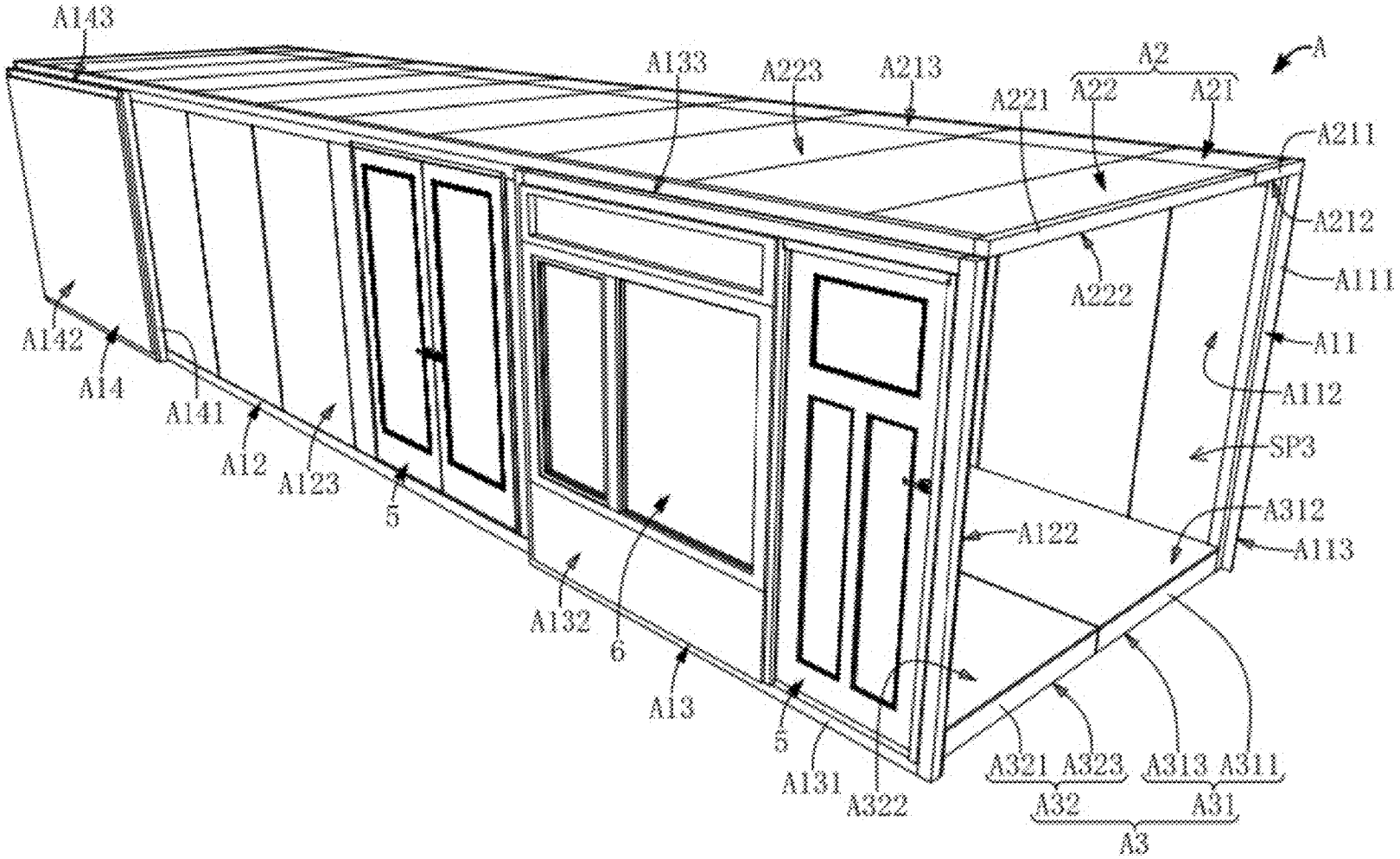
FIG. 21 is the rear perspective view of the second embodiment of the collapsible living compartment of FIG. 17 with a ceiling members and the floor members in fully expanded state.
Figure 22:
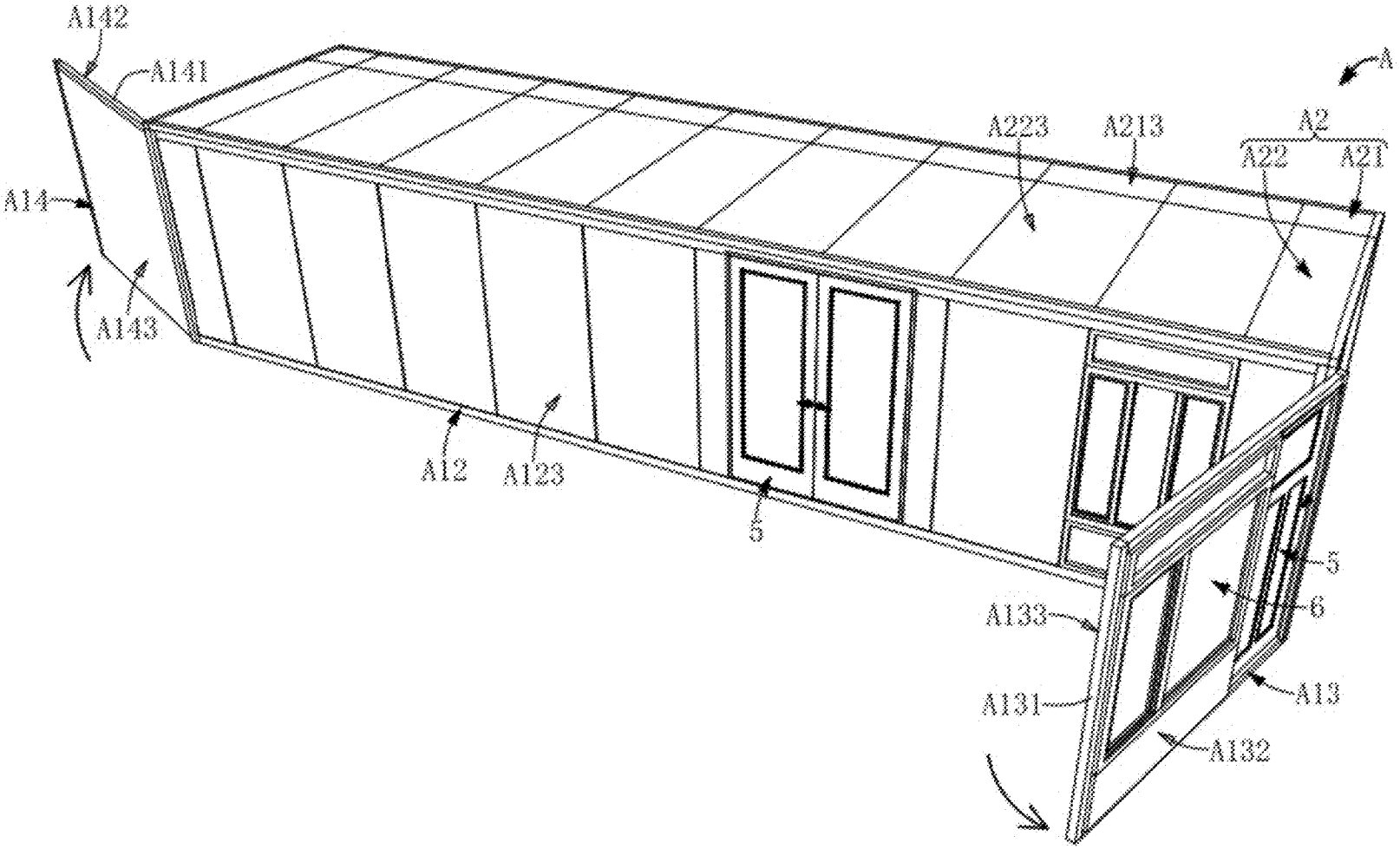
FIG. 22 is the rear perspective view of the second embodiment of the collapsible living compartment of FIG. 17 with left and right sidewalls in expanding state.

In FIG. 22, when the relative positions of the first and second ceiling members A21 and A22 are fixed, the free side of the second ceiling member A22 is fixed to the rear sidewall A12, and the relative positions of the floor members A31 and A32 are fixed, the first ceiling member A21, the second ceiling member A22, front and rear side walls A11 and 12 as well as the floor members A31 and A32 together form and define a space SP2. As shown in FIGS. 21 and 22, the left and right sidewalls A13 and A14 can be rotated such that they close off open ends of the space SP2. Free sides of the left and right sidewalls A13 and A14 are then coupled to the front sidewall A11. The collapsible living compartment 100 is now in the fully expanded state.

Figure 23:
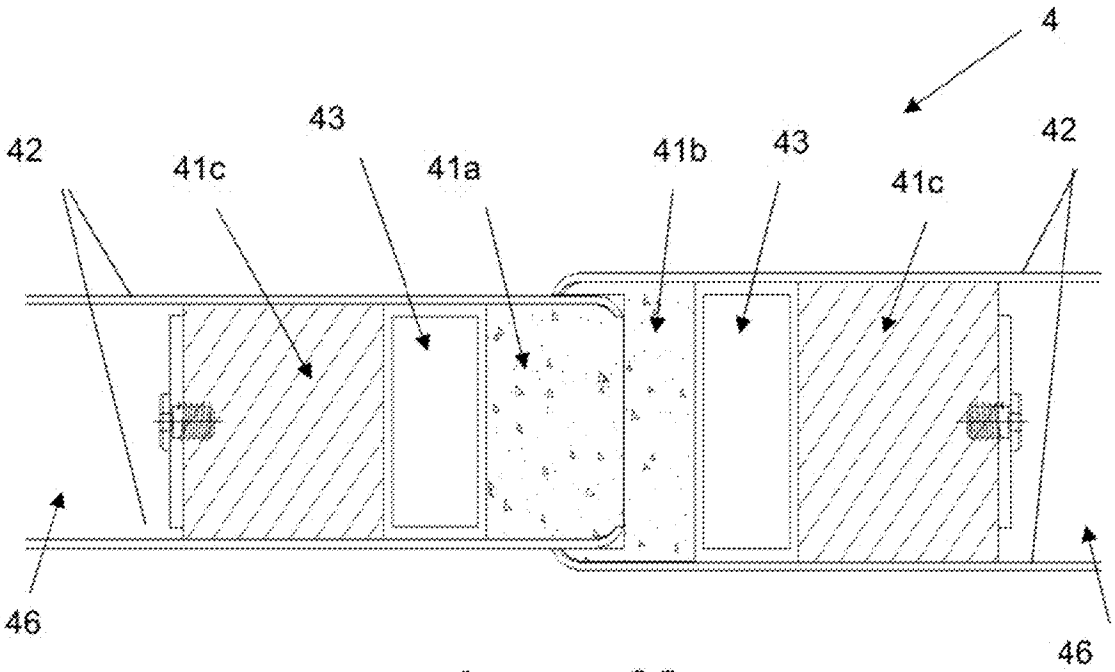
FIG. 23 is a top plan view of a portion of two panels showing a fourth embodiment of a coupler coupling the two panels.

The connections between the panels 4 as detailed in the first, second and third embodiments of the panel 4 in collapsible living compartment A is applicable in the second embodiment of the collapsible living compartment A100. A fourth embodiment is described herein and is also applicable to the collapsible living compartment A. With reference to FIG. 23, the panel 4 has two end portions. The first end portion includes a first support member 41*a* sandwiched by the outer skins 42. The outer skins 42 each includes a main body 421 and an extension 422 arranged transversely thereto. The extension 422 forms rounded end corners of the first end portion. The shape of the first support member 41 closely resembles that of the outer skin 42. The first end portion also includes a passage 43 and a further support member 41*c*. The passage 43 is sandwiched between the two support members 41 and 41*a*. The second end portion includes a second support member 42 sandwiched by the outer skins 42. The outer skins 42 each includes a main body 421 and an extension 422 arranged transversely thereto. The extension 422 forms rounded end corners of the second end portion. Again, the shape of the second support member 41*b* closely resembles that of the outer skin 42. The second end portion also includes a passage 43 and a further support member 41*c*. The passage 43 is sandwiched between the two support members 41 and 41*a*. In the second support member 42 there is provided a retainer 415 in the form of a slot or a groove configured to receive the first end portion. The second end portion is larger than the first end portion in at least on dimension, here, the width such that the first end portion of a first panel 4 can be accommodated in the retainer 415 of a second panel 4 when assembled. In a fifth embodiment, the width along the entire first panel 4 is smaller than that of the second panel 4. In other words, the difference in width is across the entire panels 4 and not just the end portions.

Figure 24A:
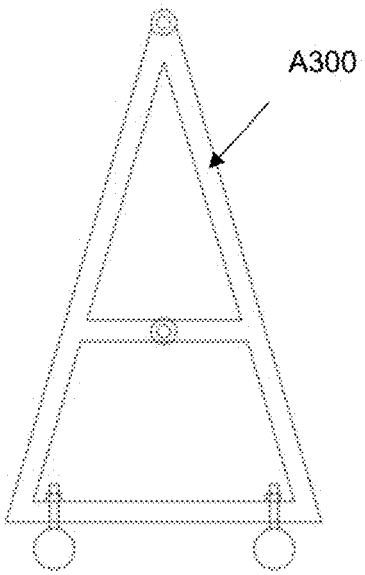
FIG. 24A is a side view of a movable support.
Figure 24B:
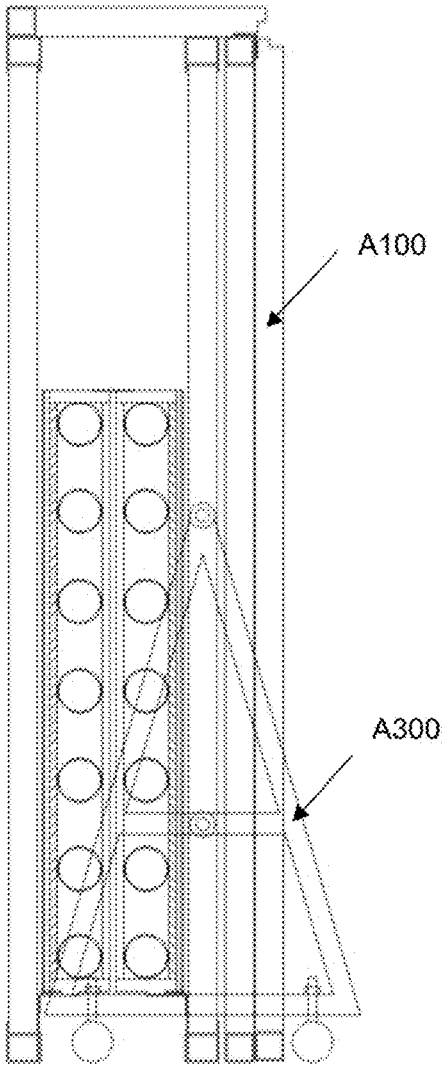
FIG. 24B is a side view of the collapsible living compartment of FIG. 17 with the movable support in FIG. 24A.

With reference to FIGS. 24A and 24B, a movable support A 300 may be provided with the collapsible living compartment A100 for easy transportation. The movable support has a triangular frame with wheels attached to its lower side.

Water-proof measures and mechanical reinforcement can be done after the full expansion or during the expansion process. The collapsible living compartment 100 may be connected to securing features provided on the surface to which is it placed. Further mechanical reinforcement such as steel beams may be added to the compartment 100. Water-proof material may be added to all joints. The pivotal connection between all frame members and the panels are made possible by way of conventional means.

The invention has been given by way of example only, and various other modifications of and/or alterations to the described embodiment may be made by persons skilled in the art without departing from the scope of the invention as specified in the appended claims.

The invention claimed is:

1. A collapsible living compartment comprising a panel having, first and second outer skins arranged parallel to one another thereby defining a space which is at least partly filled with an insulating material;

first and second supporting members sandwiched between the first and second outer skins, the first and second supporting members are arranged at opposite end portions of the space;

first and second elongated hollow tubes defining first and second passages, and positioned inside the space and between the first and second supporting members; and the first and second supporting members are structurally independent of the first and second elongated hollow tubes;

wherein the first supporting member is larger than the second supporting member in at least one dimension and the first passage is larger than the second passage in at least one dimension.

2. The collapsible living compartment as claimed in claim 1, wherein the first supporting member of one panel is configured to receive at least part of the second supporting member of another panel when the two panels are connected.

3. The collapsible living compartment as claimed in claim 2, wherein the first supporting member includes a recess for receiving at least part of the second supporting member.

4. The collapsible living compartment as claimed in claim 1, wherein the passages and the respective supporting members are provided at respective opposite end portions of the panel to define the space being filled with insulating material.

5. The collapsible living compartment as claimed in claim 1, further comprising a sidewall connecting a floor and a ceiling.

6. The collapsible living compartment as claimed in claim 5, wherein the ceiling includes a first ceiling member movably connected to a second ceiling member, relative movement between the first and second ceiling member allowing the ceiling to change between expanded and retracted states.

7. The collapsible living compartment as claimed in claim 6, wherein the first and second ceiling members each includes at least two of the panels coupled to each other.

8. The collapsible living compartment as claimed in claim 5, wherein the floor includes a first floor member movably connected to a second floor member, relative movement between the first and second floor member allowing the floor to change between expanded and retracted states.

9. The collapsible living compartment as claimed in claim 8, wherein the first and second floor members each includes at least two of the panels coupled to each other.

10. The collapsible living compartment as claimed in claim 5, wherein the sidewall includes at least two sidewall members movably connected to each other.

11. The collapsible living compartment as claimed in claim 10, wherein at least one of the side wall members includes at least two of the panels coupled to each other.

12. The collapsible living compartment as claimed in claim 5, wherein the ceiling, the floor and the sidewall are interconnected via a frame for mechanical reinforcement.

13. The collapsible living compartment as claimed in claim 12, wherein the frame includes two or more frame members movably connected with each other for changing between expanded and retracted states.

14. The collapsible living compartment as claimed in claim 1, wherein the first and second supporting members are engageable via a coupler.

15. The collapsible living compartment as claimed in claim 14, wherein the coupler comprises the first and second coupling members, the first coupling member includes a protrusion arranged to be received by a recess of the second coupling member.

16. The collapsible living compartment as claimed in claim 15, wherein the first coupling member is provided with the first supporting member and the second coupling member is provided with the second supporting member.

17. The collapsible living compartment as claimed in claim 15, wherein the outer skins are configured to form the first and second coupling members.

18. The collapsible living compartment as claimed in claim 15, wherein the first and second coupling members are of complementarily shapes.

* * * * *